US007136033B2

(12) United States Patent
Kim et al.

(10) Patent No.: US 7,136,033 B2
(45) Date of Patent: Nov. 14, 2006

(54) METHOD OF DRIVING 3-ELECTRODE PLASMA DISPLAY APPARATUS TO MINIMIZE ADDRESSING POWER

(75) Inventors: Jin-Sung Kim, Anyang (KR); Yoon-Phil Eo, Yongin (KR)

(73) Assignee: Samsung SDI Co., Ltd., Suwon-si (KR)

( * ) Notice: Subject to any disclaimer, the term of this patent is extended or adjusted under 35 U.S.C. 154(b) by 329 days.

(21) Appl. No.: 10/612,943

(22) Filed: Jul. 7, 2003

(65) Prior Publication Data

US 2004/0008162 A1 Jan. 15, 2004

(30) Foreign Application Priority Data

Jul. 12, 2002 (KR) ..... 10-2002-0040666

(51) Int. Cl.
*G09G 3/28* (2006.01)

(52) U.S. Cl. ..... 345/60; 345/66; 345/67

(58) Field of Classification Search ..... 345/67, 345/60–62, 66, 68, 204
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,326,938 | B1 * | 12/2001 | Ishida et al. | 345/63 |
| 6,483,490 | B1 * | 11/2002 | Lo | 345/60 |
| 6,630,916 | B1 | 10/2003 | Shinoda | |
| 6,707,436 | B1 | 3/2004 | Setoguchi et al. | |
| 6,862,009 | B1 * | 3/2005 | Park | 345/67 |

(Continued)

FOREIGN PATENT DOCUMENTS

JP 02-148645 6/1990

(Continued)

OTHER PUBLICATIONS

Korean Office Action of the Korean Patent Publication No. 2002-40666, issued on Jun. 28, 2004 (English translation attached).

(Continued)

*Primary Examiner*—Kee M. Tung
*Assistant Examiner*—Motilewa Good-Johnson
(74) *Attorney, Agent, or Firm*—Robert E. Bushnell, Esq.

(57) ABSTRACT

A method of driving a 3-electrode plasma display apparatus including a 3-electrode plasma display panel, a video processor, a controller, an address driver, an X-driver, a Y-driver, and a power recovery circuit is provided. In the 3-electrode plasma display panel, X-electrode lines and Y-electrode lines are alternately arranged in parallel on the rear surface of a front transparent substrate so as to form XY-electrode line pairs, and address electrode lines are arranged on the front surface of a rear transparent substrate to cross the XY-electrode line pairs. The intersections between the XY-electrode line pairs and the address electrode lines define display cells. The power recovery circuit is included in the address driver. The power recovery circuit collects charges unnecessarily remaining in the display cells at the end of application of the display data signals and applies the collected charges to the display cells at the start of application of the display data signals. The operation or non-operation of the power recovery circuit is controlled in accordance with the display data signals applied to the address electrode lines.

28 Claims, 14 Drawing Sheets

U.S. PATENT DOCUMENTS

| | | | | |
|---|---|---|---|---|
| 2001/0033257 | A1* | 10/2001 | Shin | 345/60 |
| 2002/0033781 | A1* | 3/2002 | Kang et al. | 345/67 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |
| JP | 2002-072962 | 3/2002 |
| KR | 2002-32927 | 5/2002 |

OTHER PUBLICATIONS

"*Final Draft International Standard*", Project No. 47C/61988-1/Ed. 1; Plasma Display Panels—Part I: Terminology and letter symbols, published by International Electrotechnical Commission, IEC. in 2003, and Appendix A—Description of Technology, Annex B—Relationship Between Voltage Terms And Discharge Characteristics; AnnexC—Gaps and Annex D—Manufacturing.

Chinese Office Action of the Chinese Patent Application No. 03155525.X, issued on Mar. 31, 2006.

* cited by examiner

METHOD OF DRIVING 3-ELECTRODE PLASMA DISPLAY APPARATUS TO MINIMIZE ADDRESSING POWER

CLAIM OF PRIORITY

This application makes reference to, incorporates the same herein, and claims all benefits accruing under 35 U.S.C. §119 from my application entitled METHOD OF DRIVING 3-ELECTRODE PLASMA DISPLAY APPARATUS TO MINIMIZE ADDRESSING POWER filed with the Korean Industrial Property Office on Jul. 12, 2002 and there duly assigned Serial No. 2002-40666.

BACKGROUND OF THE INVENTION

1. Technical Field

The present invention relates to method of driving a flat display apparatus, and more particularly, to a method of driving a 3-electrode plasma display apparatus.

2. Related Art

Flat display panels have been becoming more and more popular as display devices. The combination of the thin depth and large display area has proven to be appealing to consumers. Efforts are being made to improve picture quality and reduce power demands associated with flat display panels.

An exemplar of a recent effort in the art is disclosed, for example, in U.S. Pat. No. 5,541,618 for METHOD AND A CIRCUIT FOR GRADATIONALLY DRIVING A FLAT DISPLAY DEVICE issued on 30 Jul. 1996 to Shinoda.

In a structure of a surface discharge type 3-electrode plasma display panel, address electrode lines are formed on a front surface of a rear glass substrate of the panel in a predetermined pattern. A rear dielectric layer is formed on the front surface of the rear glass substrate. Partition walls are formed on the front surface of the rear dielectric layer to be parallel to the address electrode lines. These partition walls define the discharge areas of respective display cells and serve to prevent cross talk between display cells. Phosphor layers are formed between partition walls. A driving method adapted to such a plasma display panel is to sequentially perform initialization, addressing, and display-sustaining. Unfortunately, as a result of using this driving method, in each subfield an address period increases and a display-sustaining period decreases, and, as a result, the problem is that the brightness of light emitted from the plasma display panel decreases.

In some driving methods, a large addressing power is generated for video data having a large sum of data variations between lines and a large sum of data variations between cells, and a large addressing power is generated for video data having a large number of display cells to be turned on and a large number of display cells to be turned off in adjacency of the respective display cells to be turned on. In the above-described driving methods and others, unnecessary addressing power is generated because of the fact that the characteristics of video data are not taken into consideration.

SUMMARY OF THE INVENTION

The present invention provides a method of driving a 3-electrode plasma display apparatus, through which generation of unnecessary addressing power is prevented by adaptively reflecting the characteristics of video data.

According to an aspect of the present invention, there is provided a method of driving a 3-electrode plasma display apparatus including a 3-electrode plasma display panel, a video processor, a controller, an address driver, an X-driver, a Y-driver, and a power recovery circuit. In the 3-electrode plasma display panel, X-electrode lines and Y-electrode lines are alternately arranged in parallel on the rear surface of a front transparent substrate so as to form XY-electrode line pairs, and address electrode lines are arranged on the front surface of a rear transparent substrate to cross the XY-electrode line pairs. The intersections between the XY-electrode line pairs and the address electrode lines define display cells. The video processor converts an external analog video signal into a digital signal to generate an internal video signal. The controller generates drive control signals in response to the internal video signal from the video processor. The address driver processes an address signal output from the controller to generate display data signals and applies the display data signals to the address electrode lines. The X-driver processes an X-drive control signal output from the controller and applies the result of processing to the X-electrode lines. The Y-driver processes a Y-drive control signal output from the controller and applies the result of processing to the Y-electrode lines. The power recovery circuit is included in the address driver. The power recovery circuit collects charges unnecessarily remaining in the display cells at the end of application of the display data signals and applies the collected charges to the display cells at the start of application of the display data signals. The operation or non-operation of the power recovery circuit is controlled in accordance with the display data signals applied to the address electrode lines.

According to the method of the present invention, the operation or non-operation of the power recovery circuit is controlled in accordance with the display data signals applied to the address electrode lines so that the characteristics of video data are adaptively reflected. Consequently, generation of unnecessary addressing power can be prevented.

In accordance with the principles of the present invention, as embodied and broadly described, the present invention provides a method of driving a 3-electrode plasma display apparatus, the method comprising: converting an external analog video signal into a digital signal to generate an internal video signal; generating drive control signals at a controller in response to the internal video signal; processing an X-drive control signal output from the controller and applying the result of said processing of the X-drive control signal to X-electrode lines; processing a Y-drive control signal output from the controller and applying the result of said processing of the Y-drive control signal to Y-electrode lines; processing an address signal at an address driver to generate display data signals and applying the display data signals to address electrode lines, the address signal being output from the controller, the apparatus including a 3-electrode plasma display panel, with the panel including the X-electrode lines, Y-electrode lines, and address electrode lines, the X-electrode lines and Y-electrode lines being alternately arranged in parallel on a rear surface of a front transparent substrate to form XY-electrode line pairs, the address electrode lines being arranged on a front surface of a rear transparent substrate to cross the XY-electrode line pairs, with intersections of the XY-electrode line pairs and the address electrode lines defining display cells; collecting excess charges remaining in the display cells when said applying of the display data signals ends, said collecting being performed by a power recovery circuit included in the address driver; applying the collected changes to the display cells when said applying of the display data signals starts; and controlling operation and non-operation of the power recovery circuit in dependence upon said applying of the display data signals to the address electrode lines.

The present invention is more specifically described in the following paragraphs by reference to the drawings attached only by way of example. Other advantages and features will become apparent from the following description and from the claims.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF BEST MODE OF CARRYING OUT THE INVENTION

While the present invention will be described more fully hereinafter with reference to the accompanying drawings, in which details of the present invention are shown, it is to be understood at the outset of the description which follows that persons of skill in the appropriate arts may modify the invention here described while still achieving the favorable results of this invention. Accordingly, the description of the best mode contemplated of carrying out the invention, which follows, is to be understood as being a broad, teaching disclosure directed to persons of skill in the appropriate arts, and not as limiting upon the present invention.

Illustrative embodiments of the best mode of carrying out the invention are described below. In the interest of clarity, not all features of an actual implementation are described. In the following description, well-known functions, constructions, and configurations are not described in detail since they could obscure the invention with unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

Figure 1:
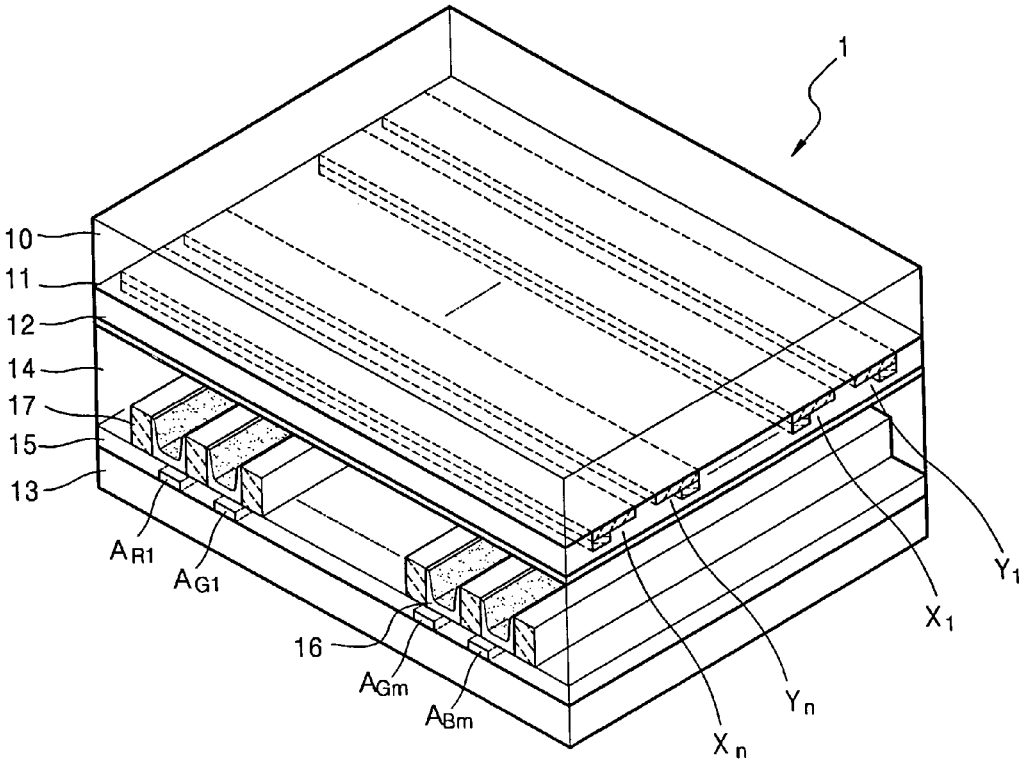
FIG. 1 is a perspective view of the inner structure of a surface discharge type 3-electrode plasma display panel.
Figure 2:
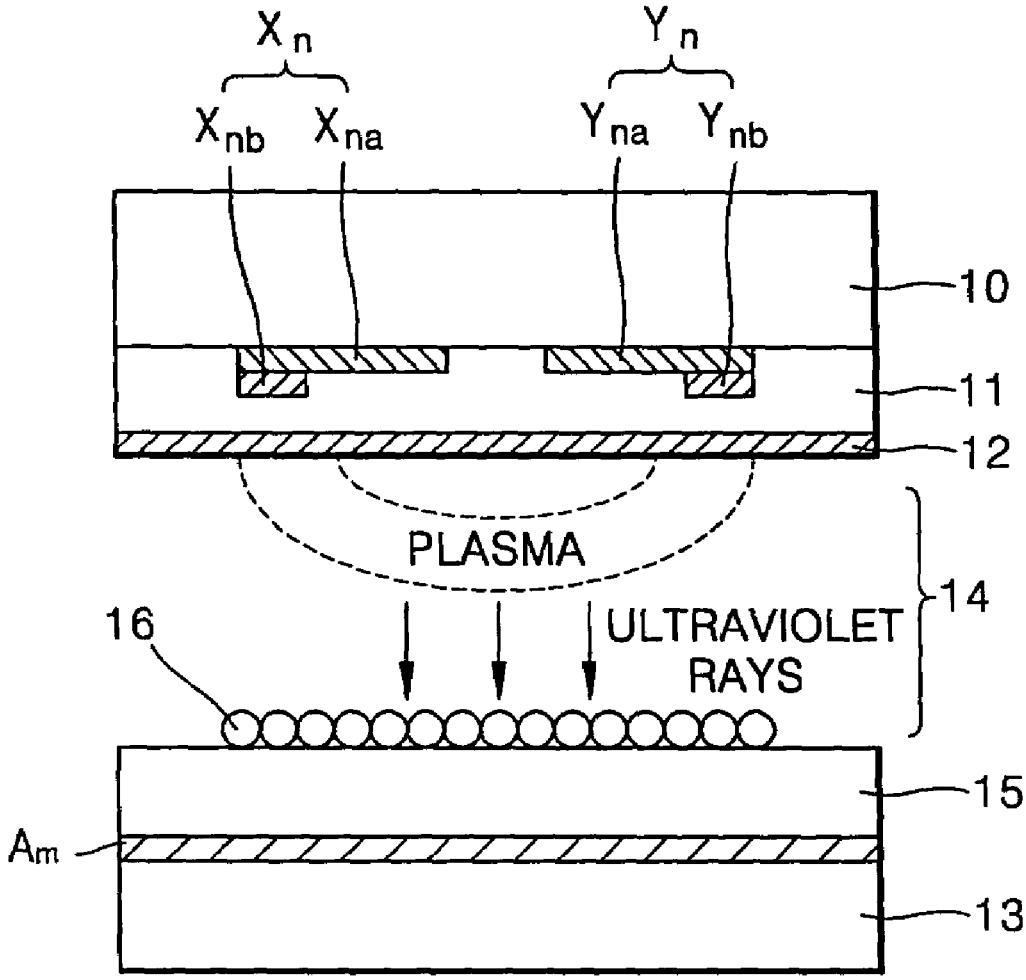
FIG. 2 is a cross-section of an example of a display cell of the 3-electrode plasma display panel shown in FIG. 1.

FIG. 1 is a perspective view of the inner structure of a surface discharge type 3-electrode plasma display panel. FIG. 2 is a cross-section of an example of a display cell of the 3-electrode plasma display panel shown in FIG. 1.

Referring to FIGS. 1 and 2, address electrode lines $A_{R1}$, $A_{R2}$, . . . , $A_{Gm}$, $A_{Bm}$, dielectric layers 11 and 15, Y-electrode lines $Y_1$, . . . , $Y_n$, X-electrode lines $X_1$, . . . , $X_n$, phosphor layers 16, partition walls 17, and a magnesium oxide (MgO) layer 12 as a protective layer are provided between front and rear glass substrates 10 and 13 of a general surface discharge type 3-electrode plasma display panel 1.

The address electrode lines $A_{R1}$ through $A_{Bm}$ are formed on the front surface of the rear glass substrate 13 in a predetermined pattern. A rear dielectric layer 15 is formed on the front surface of the rear glass substrate 13 having the address electrode lines $A_{R1}$ through $A_{Bm}$. The partition walls 17 are formed on the front surface of the rear dielectric layer 15 to be parallel to the address electrode lines $A_{R1}$ through $A_{Bm}$. These partition walls 17 define the discharge areas of respective display cells and serve to prevent cross talk between display cells. The phosphor layers 16 are formed between partition walls 17.

The X-electrode lines $X_1$, through $X_n$ and the Y-electrode lines $Y_1$ through $Y_n$ are formed on the rear surface of the front glass substrate 10 in a predetermined pattern to be orthogonal to the address electrode lines $A_{R1}$ through $A_{Bm}$. The respective intersections define display cells. Each of the X-electrode lines $X_1$ through $X_n$ is composed of a transparent electrode line $X_{na}$ (FIG. 2) formed of a transparent conductive material, e.g., indium tin oxide (ITO), and a metal electrode line $X_{nb}$ (FIG. 2) for increasing conductivity. Each of the Y-electrode lines $Y_1$ through $Y_n$ is composed of a transparent electrode line $Y_{na}$ (FIG. 2) formed of a transparent conductive material, e.g., ITO, and a metal electrode line $Y_{nb}$ (FIG. 2) for increasing conductivity. A front dielectric layer 11 is deposited on the rear surface of the front glass substrate 10 having the X-electrode lines $X_1$ through $X_n$ and the Y-electrode lines $Y_1$ through $Y_n$. The protective layer 12, e.g., a MgO layer, for protecting the panel 1 against a strong electrical field is deposited on the entire rear surface of the front dielectric layer 11. A gas for forming plasma is hermetically sealed in a discharge space 14.

A driving method generally adapted to such a plasma display panel as described above is to sequentially perform an initialization step, an address step and a display-sustaining step in a unit subfield. In the initialization step, charges in display cells to be driven are uniform. In the address step, the charge state of display cell to be turned on and the charge state of display cells to be turned off are determined. In the display-sustaining step, display cells to be turned on perform display discharge. Here, since a plurality of unit subfields are included in a unit frame, a desired grayscale can be displayed by adjusting the duration of the display-sustaining period of each subfield.

Figure 3:
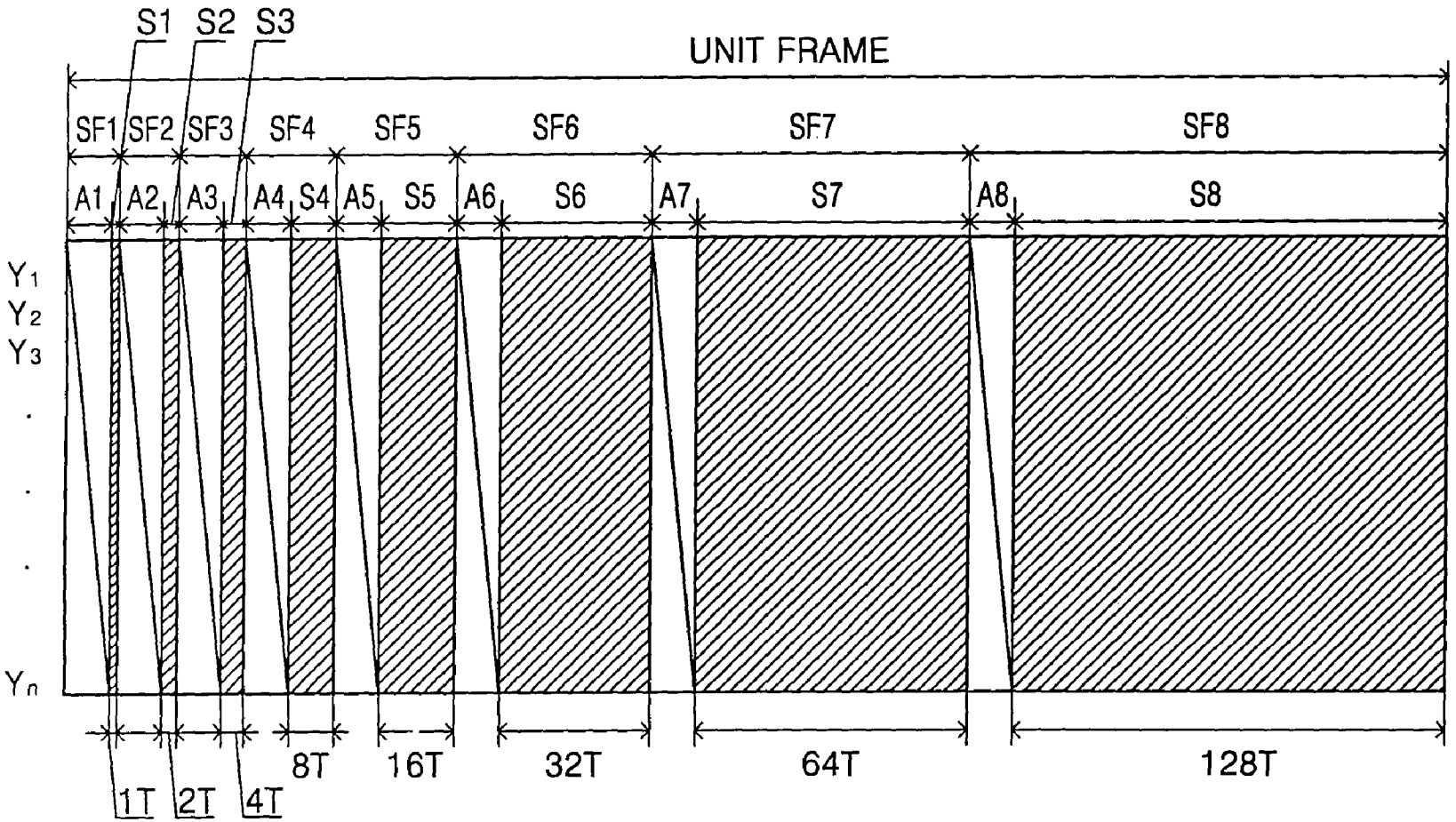
FIG. 3 is a timing chart illustrating an address-display separation driving method with respect to Y-electrode lines of the 3-electrode plasma display panel shown in FIG. 1.

FIG. 3 is a timing chart illustrating an address-display separation driving method with respect to Y-electrode lines of the 3-electrode plasma display panel shown in FIG. 1. FIG. 3 shows an address-display separation driving method with respect to Y-electrode lines of the 3-electrode plasma display panel shown in FIG. 1. The U.S. Pat. No. 5,541,618 issued to Shinoda includes some information.

Referring to FIG. 3, to realize time-division grayscale display, a unit frame is divided into 8 subfields SF1 through SF8. In addition, the individual subfields SF1 through SF8 are composed of address periods A1 through A8, respectively, and display-sustaining periods S1 through S8, respectively.

During each of the address periods A1 through A8, display data signals are applied to the address electrode lines $A_{R1}$ through $A_{Bm}$ of FIG. 1, and simultaneously, a scan pulse is sequentially applied to the Y-electrode lines $Y_1$ through $Y_n$. If a high-level display data signal is applied to some of the address electrode lines $A_{R1}$ through $A_{Bm}$ while the scan pulse is applied, wall charges are induced from address discharge only in relevant display cells.

During each of the display-sustaining periods S1 through S8, a display discharge pulse is alternately applied to the Y-electrode lines $Y_1$ through $Y_n$ and the X-electrode lines $X_1$ through $X_n$, thereby provoking display discharge in display cells in which wall charges are induced during each of the address periods A1 through A8. Accordingly, the brightness of aplasma display panel is proportional to a total length of the display-sustaining periods S1 through S8 in a unit frame. The total length of the display-sustaining periods S1 through S8 in a unit frame is 255T (T is a unit time). Accordingly, including a case where the unit frame is not displayed, 256 grayscales can be displayed.

Here, the display-sustaining period S1 of the first subfield SF1 is set to a time 1T corresponding to $2^0$. The display-sustaining period S2 of the second subfield SF2 is set to a time is 2T corresponding to $2^1$. The display-sustaining period S3 of the third subfield SF3 is set to a time 4T corresponding to $2^2$. The display-sustaining period S4 of the fourth subfield SF4 is set to a time 8T corresponding to $2^3$. The display-sustaining period S5 of the fifth subfield SF5 is set to a time 16T corresponding to $2^4$. The display-sustaining period S6 of the sixth subfield SF6 is set to a time 32T corresponding to $2^5$. The display-sustaining period S7 of the seventh subfield SF7 is set to a time 64T corresponding to $2^6$. The display-sustaining period S8 of the eighth subfield SF8 is set to a time 128T corresponding to $2^7$. Accordingly, if a subfield to be displayed is appropriately selected from among 8 subfields, a total of 256 grayscales including a gray level of zero at which display is not performed in any subfield can be displayed.

According to the above-described address-display separation display method, the time domains of the respective subfields SF1 through SF8 are separated, so the time domains of respective address periods of the subfields SF1 through SF8 are separated, and the time domains of respective display-sustaining periods of the subfields SF1 through SF8 are separated. Accordingly, during an address period, an XY-electrode line pair is kept waiting after being addressed until all of the other XY-electrode line pairs are addressed. Consequently, in each subfield, an address period increases, and a display-sustaining period decreases. As a result, the brightness of light emitted from a plasma display panel decreases. A method proposed for overcoming this problem is an address-while-display driving method as shown in FIG. 4.

Figure 4:
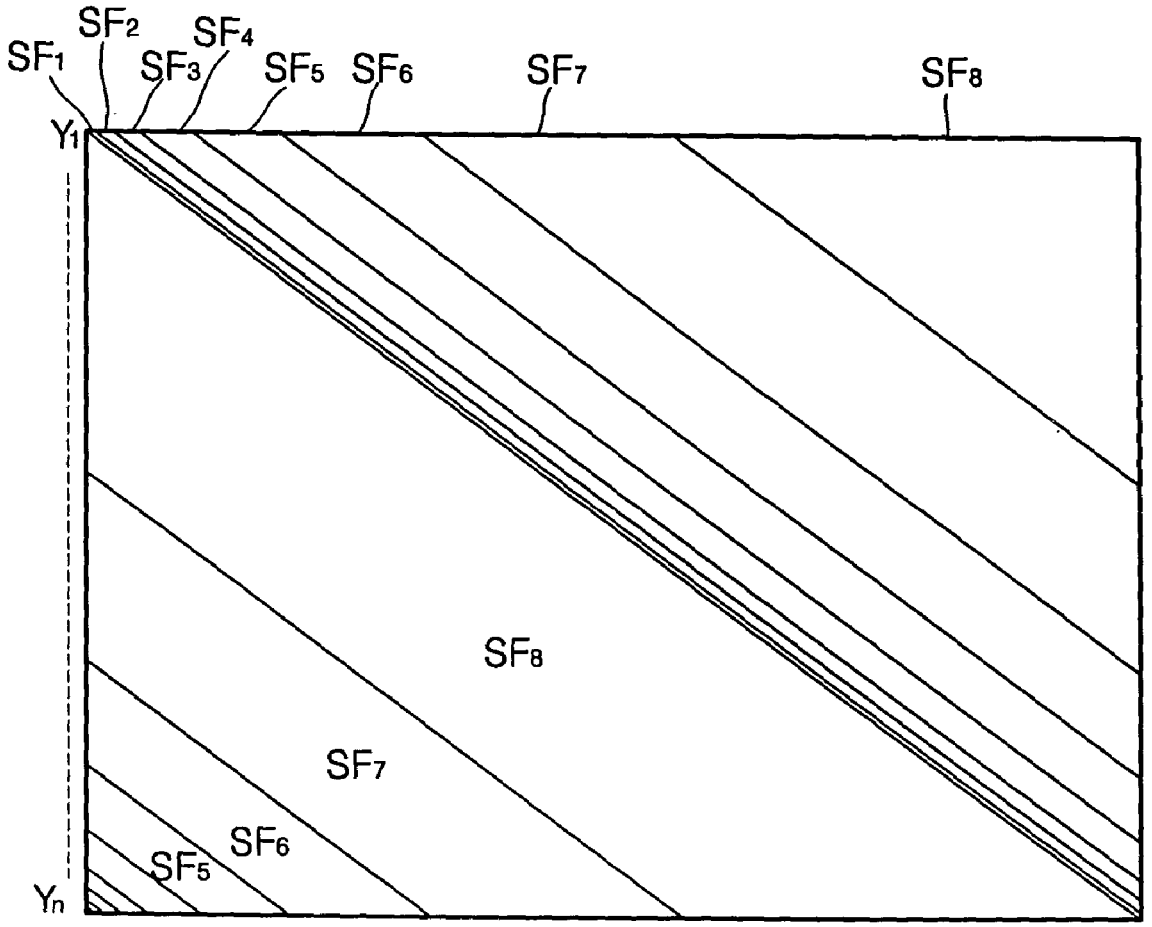
FIG. 4 is a timing chart illustrating an address-while-display driving method with respect to the Y-electrode lines of the 3-electrode plasma display panel shown in FIG. 1.

FIG. 4 is a timing chart illustrating an address-while-display driving method with respect to theY-electrode lines of the 3-electrode plasma display panel shown in FIG. 1. Referring to FIG. 4, to realize time-division grayscale display, a unit frame is divided into 8 subfields SF, through $SF_8$. Here, the subfields $SF_1$ through $SF_8$ overlap with respect to the Y-electrode lines $Y_1$ through $Y_n$ and constitute a unit frame. Since all of the subfields $SF_1$ through $SF_8$ exist at any time point, address time slots are set among display discharge pulses in order to perform each address step.

In each of the subfields $SF_1$ through $SF_8$, a reset step, address step, and display-sustaining step are performed. A time allocated to each of the subfields $SF_1$ through $SF_8$ depends on a display discharge time corresponding to a grayscale. For example, when displaying 256 grayscales with 8-bit video data in units of frames, if a unit frame (usually, 1/60 second) is composed of 256 unit times, the first subfield $SF_1$ driven according to video data of the least significant bit has 1 ($2^0$) unit time, the second subfield $SF_2$ has 2 ($2^1$) unit times, the third subfield $SF_3$ has 4 ($2^2$) unit times, the fourth subfield $SF_4$ has 8 ($2^3$) unit times, the fifth subfield $SF_5$ has 16 ($2^4$) unit times, the sixth subfield $SF_6$ has 32 ($2^5$) unit times, the seventh subfield $SF_7$ has 64 ($2^6$) unit times, and the eighth subfield $SF_8$ driven according to video data of the most significant bit has 128 ($2^7$) unit times. Since the sum of unit times allocated to the subfields $SF_1$ through $SF_8$ is 255,255 grayscale display can be accomplished. If a grayscale having no display discharge in any subfield is included, 256 grayscale display can be accomplished.

Figure 5:
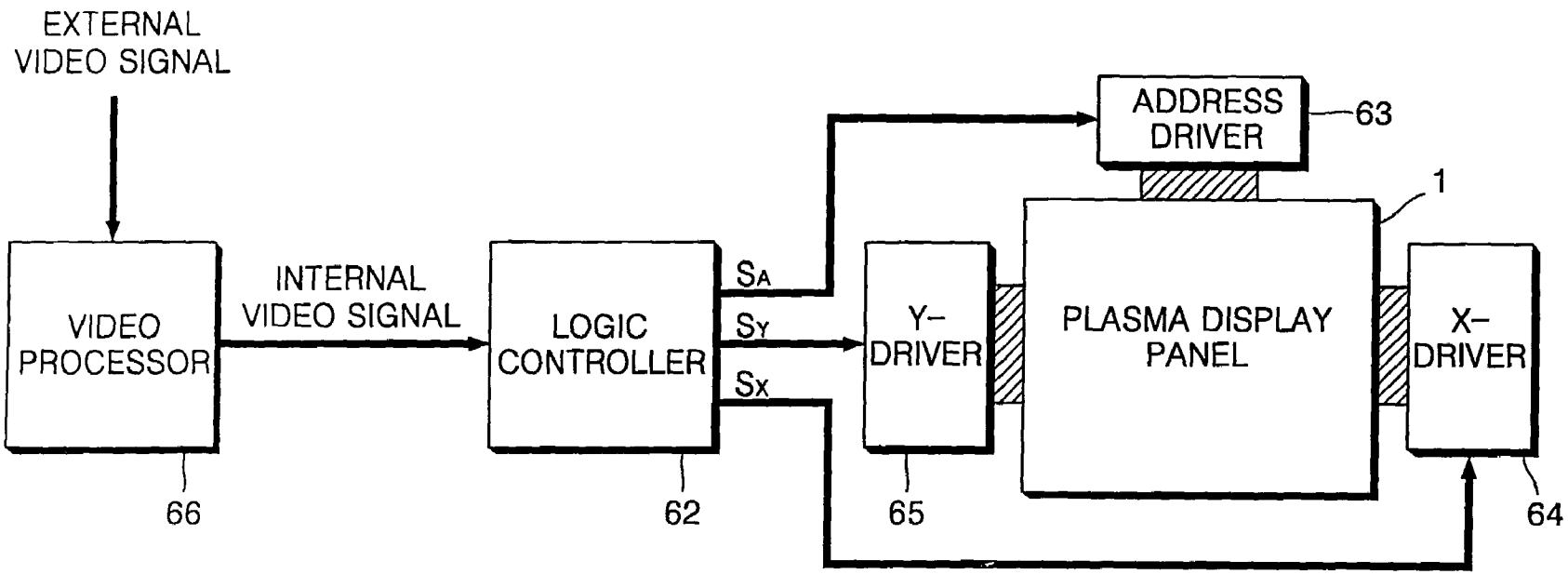
FIG. 5 is a block diagram of a driving apparatus for the 3-electrode plasma display panel shown in FIG. 1.

FIG. 5 is a block diagram of a driving apparatus for the 3-electrode plasma display panel shown in FIG. 1. Referring to FIG. 5, the driving apparatus for the 3-electrode plasma display panel 1 includes a video processor 66, a logic controller 62, an address driver 63, an X-driver 64, and a Y-driver 65. The video processor 66 converts an external analog video signal into a digital signal to generate an internal video signal composed of, for example, 8-bit red (R) video data, 8-bit green (G) video data, 8-bit blue (B) video data, a clock signal, a horizontal synchronizing signal, and a vertical synchronizing signal. The logic controller 62 generates drive control signals $S_A$, $S_Y$, and $S_X$ in response to the internal video signal from the video processor 66. The address driver 63 processes the address signal $S_A$ among the drive control signals $S_A$, $S_Y$, and $S_X$ output from the logic controller 62 to generate display data signals and applies the display data signals to address electrode lines ($A_{R1}$ through $A_{Bm}$ in FIG. 1). The X-driver 64 processes the X-drive control signal $S_X$ among the drive control signals $S_A$, $S_Y$, and $S_X$ output from the logic controller 62 and applies the result of processing to X-electrode lines. The Y-driver 65 processes the Y-drive control signal $S_Y$ among the drive control signals $S_A$, $S_Y$, and $S_X$ output from the logic controller 62 and applies the result of processing to Y-electrode lines.

Figure 6:
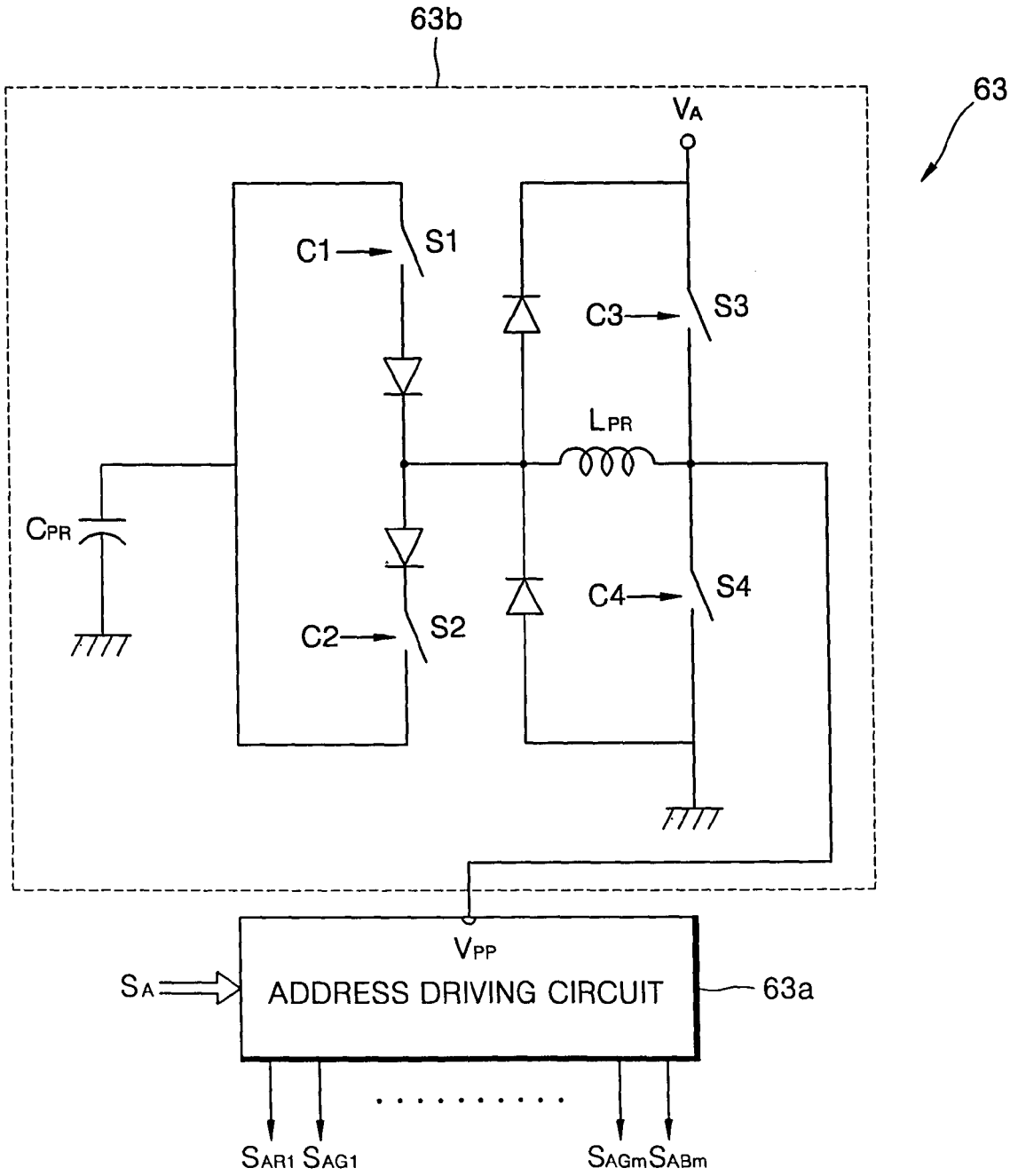
FIG. 6 is diagram showing a power recovery circuit included in the address driver shown in FIG. 5.

FIG. 6 is diagram showing a power recovery circuit included in the address driver shown in FIG. 5. FIG. 6 shows a power recovery circuit 63*b* included in the address driver 63 shown in FIG. 5. Referring to FIGS. 1, 5, and 6, an address driving circuit 63*a* included in the address driver 63 processes the address signal $S_A$ among the drive control signals $S_A$, $S_Y$, and $S_X$ output from the logic controller 62 to generate display data signals $S_{AR1}$, $S_{AG1}$, . . . , $S_{AGm}$, $S_{ABm}$ and applies the display data signals $S_{AR1}$ through $S_{ABm}$ to address electrode lines $A_{R1}$ through $A_{Bm}$. A power supply voltage $V_A$, i.e., an addressing voltage, of the address driving circuit 63*a* is controlled by the operation of the power recovery circuit 63*b* to collect unnecessary residual charges from display cells in the 3-electrode plasma display panel 1 at the end of application of the display data signals $S_{AR1}$ through $S_{ABm}$ and apply the collected charges to display cells at the start of application of the display data signals $S_{AR1}$ through $S_{ABm}$. The inductance of a resonance coil $L_{PR}$ in the power recovery circuit 63*b* is set such as to allow resonance to be performed on an average operating capacitance of the 3-electrode plasma display panel 1. The following description concerns the step-by-step operation of the power recovery circuit 63*b*.

When the application of the display data signals $S_{AR1}$ through $S_{ABm}$ ends, only a second switch S2 is turned on, and thus charges unnecessarily remaining in display cells in the 3-electrode plasma display panel 1 are collected in a charge/discharge capacitor $C_{PR}$ through a power supply voltage input terminal $V_{pp}$ of the address driving circuit 63*a*, the resonance coil $L_{PR}$, and the second switch S2.

Next, only a fourth switch S4 is turned on, and thus the power supply voltage $V_A$ of the address driving circuit 63*a* becomes a ground voltage. Next, when the application of the display data signals $S_{AR1}$ through $S_{ABm}$ starts, only a first switch S1 is turned on, and thus the charges collected in the charge/discharge capacitor $C_{PR}$ are applied to display cells of the 3-electrode plasma display panel 1 through the first switch S1, the resonance $coil_{LPR}$, and the power supply voltage input terminal $V_{pp}$ of the address driving circuit 63*a*. Next, only a third switch S3 is turned on, and thus the power supply voltage $V_A$ is applied to the address driving circuit 63*a*, and the display data signals $S_{AR1}$ through $S_{ABm}$ are applied.

The above-described steps are periodically repeated in synchronization with a periodical and sequential scanning of each XY-electrode line pair.

Figure 7:
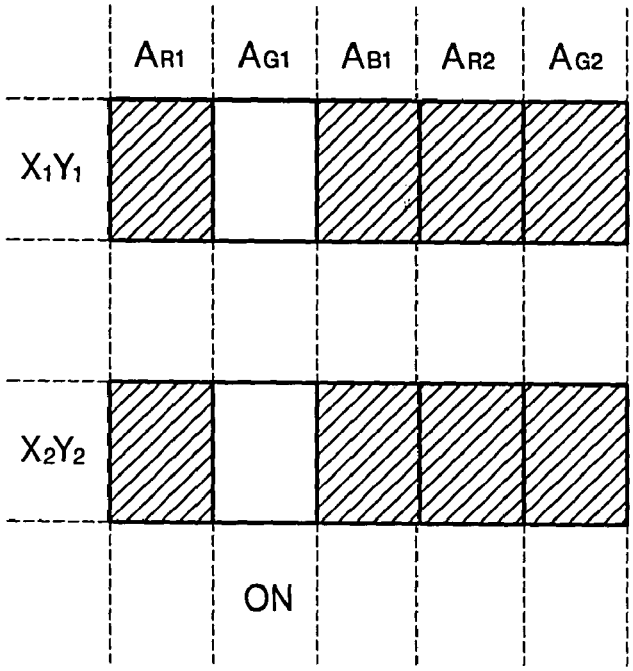
FIG. 7 is a diagram showing an example of the logic state of the display data of a first XY-electrode line pair to be scanned first and the display data of a second XY-electrode line pair to be scanned next.

FIG. 7 is a diagram showing an example of the logic state of the display data of a first XY-electrode line pair to be scanned first and the display data of a second XY-electrode line pair to be scanned next. FIG. 7 shows an example of the logic state of the display data of a first XY-electrode line pair $X_1Y_1$ to be scanned first and the display data of a second XY-electrode line pair $X_2Y_2$ to be scanned next. In FIGS. 1 and 7, the same reference numerals denote an element having the same function. Referring to FIG. 7, the data of a first green address electrode line $A_{G1}$ is in an ON state with respect to both first and second XY-electrode line pairs $X_1Y_1$ and $X_2$ $Y_2$.

Figure 8A:
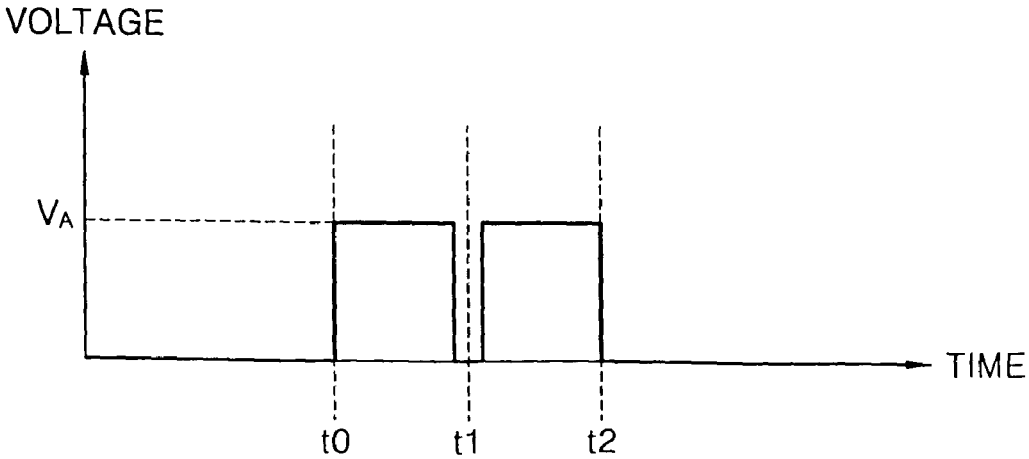
FIG. 8A is a diagram showing the waveform of display data applied to a first green address electrode line shown in FIG. 7 when the power recovery circuit shown in FIG. 6 operates, in accordance with a first driving method.

FIG. 8A is a diagram showing the waveform of display data applied to a first green address electrode line shown in FIG. 7 when the power recovery circuit shown in FIG. 6 operates, in accordance with a first driving method. FIG. 8A shows the waveform of display data applied to the first green address electrode line $A_{G1}$ shown in FIG. 7 when the power recovery circuit 63*b* shown in FIG. 6 operates, in accordance with the first driving method. Referring to FIG. 8A, when the power recovery circuit 63*b* operates, intermittent pulses are applied even though there is no change in the ON data.

Figure 8B:
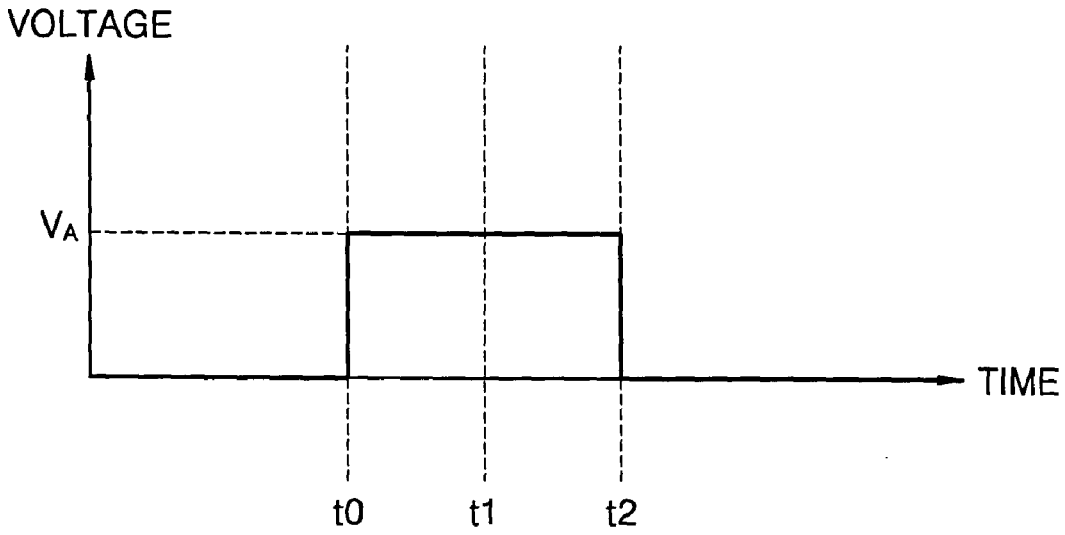
FIG. 8B is a diagram showing the waveform of display data applied to the first green address electrode line shown in FIG. 7 when the power recovery circuit shown in FIG. 6 does not operate, in accordance with a second driving method.

FIG. 8B is a diagram showing the waveform of display data applied to the first green address electrode line shown in FIG. 7 when the power recovery circuit shown in FIG. 6 does not operate, in accordance with a second driving method. FIG. 8B shows the waveform of display data applied to the first green address electrode line $A_{G1}$ shown in FIG. 7 when the power recovery circuit 63*b* shown in FIG. 6 does not operate, in accordance with the second driving method. Referring to FIG. 8B, when the power recovery circuit 63*b* does not operate, continuous pulses are applied since there is no change in the ON data.

Figure 9:
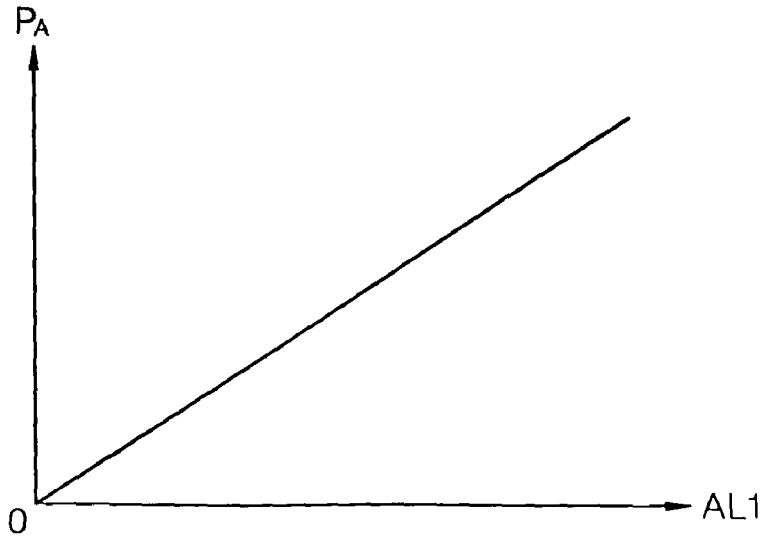
FIG. 9 is a graph showing an addressing power versus an address load factor when the power recovery circuit shown in FIG. 6 does not operate, in accordance with the second driving method reflected in FIG. 8B.

FIG. 9 is a graph showing an addressing power versus an address load factor when the power recovery circuit shown in FIG. 6 does not operate, in accordance with the second driving method reflected in FIG. 8B. FIG. 9 is a graph showing an addressing power $P_A$ versus an address load factor AL1 when the power recovery circuit 63*b* shown in FIG. 6 does not operate, in accordance with the second driving method reflected in FIG. 8B. Here, the address load factor AL1 is proportional to the sum of data variations between lines and the sum of data variations between cells, that is, data variations between display cells relevant to the data variations between lines and their adjacent display cells. In other words, referring to FIG. 9, it can be inferred that the addressing power $P_A$ is proportional to the sum of the data variations between lines and the sum of the data variation between cells.

Figure 10:
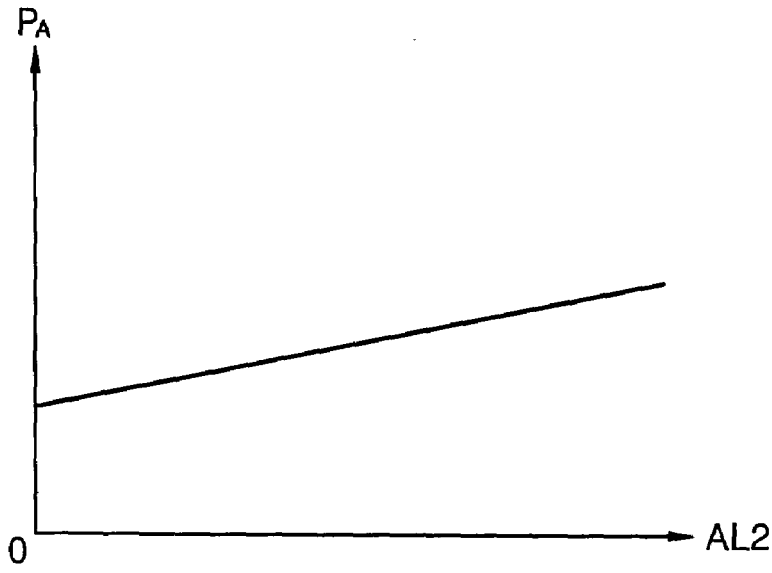
FIG. 10 is a graph showing an addressing power versus an address load factor when the power recovery circuit shown in FIG. 6 operates, in accordance with the first driving method reflected in FIG. 8A.

FIG. 10 is a graph showing an addressing power versus an address load factor when the power recovery circuit shown in FIG. 6 operates, in accordance with the first driving method reflected in FIG. 8A. FIG. 10 is a graph showing an addressing power $P_A$ versus an address load factor AL2 when the power recovery circuit 63*b* shown in FIG. 6 operates, in accordance with the first driving method reflected in FIG. 8A. Here, the address load factor AL2 is proportional to the number of display cells to be turned on and the number of display cells to be turned off in adjacency of the respective display cells to be turned on. In other words, referring to FIG. 10, it can be inferred that the address load factor AL2 is proportional to the number of display cells to be turned on and the number of display cells to be turned off in adjacency of the respective display cells to be turned on.

Accordingly, the driving method reflected in FIG. 8B has a problem in that a large addressing power is generated for video data having a large sum of data variations between lines and a large sum of data variations between cells. The driving method reflected in FIG. 8A has a problem in that a large addressing power is generated for video data having a large number of display cells to be turned on and a large number of display cells to be turned off in adjacency of the respective display cells to be turned on.

Briefly, in the above-described driving methods, unnecessary addressing power is generated because the characteristics of video data are not reflected.

Hereinafter, preferred embodiments of the present invention will be described in detail with reference to the attached drawings. Referring to FIGS. 1, 5, and 6, the present invention relates to a method of driving a 3-electrode plasma display apparatus including the 3-electrode plasma display panel 1, the video processor 66, the logic controller 62, the address driver 63 including the power recovery circuit 63*b*, the X-driver 64, and the Y-driver 65.

In the 3-electrode plasma display panel 1, the X-electrode lines $X_1$ through $X_n$ and the Y-electrode lines $Y_1$ through $Y_n$ are alternately arranged in parallel on the rear surface of the front glass substrate 10 so as to form XY-electrode line pairs $X_1Y_1$ through $X_nY_n$. The address electrode lines $A_{R1}$ through $A_{Bm}$ are arranged on the front surface of the rear glass substrate 13 to cross the XY-electrode line pairs $X_1Y_1$ through $X_nY_n$. The respective intersections define display cells.

The video processor 66 converts an external analog video signal into a digital signal to generate an internal video signal composed of, for example, 8-bit red (R) video data, 8-bit green (G) video data, 8-bit blue (B) video data, a clock signal, a horizontal synchronizing signal, and a vertical synchronizing signal. The logic controller 62 generates drive control signals $S_A$, $S_Y$, and $S_X$ in response to the internal video signal from the video processor 66. The address driver 63 processes the address signal $S_A$ among the drive control signals $S_A$, $S_Y$, and $S_X$ output from the logic controller 62 to generate display data signals and applies the display data signals to the address electrode lines $A_{R1}$ through $A_{Bm}$. The X-driver 64 processes the X-drive control signal $S_X$ among the drive control signals $S_A$, $S_Y$, and $S_X$ output from the logic controller 62 and applies the result of processing to X-electrode lines. The Y-driver 65 processes the Y-drive control signal $S_Y$ among the drive control signals $S_A$, $S_Y$, and $S_X$ output from the logic controller 62 and applies the result of processing to Y-electrode lines.

The power recovery circuit 63*b* collects charges unnecessarily remaining in display cells in the 3-electrode plasma display panel 1 at the end of application of display data signals $S_{AR1}$ through $S_{ABm}$. In other words, the power recovery circuit 63*b* collects "excess charges" remaining in display cells at the end of application of the display data signals. These "excess charges" are charges remaining in display cells even though these charges are not immediately needed in those display cells. Then the power recovery circuit 63*b* applies the collected charges to display cells at the start of application of the display data signals $S_{AR1}$ through $S_{ABm}$.

More specifically, a driving method fundamentally adapted to the 3-electrode plasma display panel 1 is to sequentially perform an initialization step, an address step and a display-sustaining step in a unit subfield. In the initialization step, charges in display cells to be driven are uniform. In the address step, the charge state of display cell to be turned on and the charge state of display cells to be turned off are determined. In the display-sustaining step, the display cells to be turned on perform a display discharge. Here, the operation or non-operation of the power recovery circuit 63*b* is controlled in accordance with the display data signals $S_{AR1}$ through $S_{ABm}$ respectively applied to the address electrode lines $A_{R1}$ through $A_{Bm}$ in the address step.

In a first embodiment of the present invention, under the condition that the operation or non-operation of the power recovery circuit 63*b* is controlled for each subfield in accordance with display data signals of the subfield, an addressing power during the non-operation of the power recovery circuit 63*b* is predicted, and the power recovery circuit 63*b* is operated when the addressing power exceeds a predetermined reference value.

The following description concerns a method of predicting the addressing power. Through this method, the operation or non-operation of the power recovery circuit 63*b* can be controlled for each subfield in accordance with the display data signals of the subfield, and the operation or non-operation of the power recovery circuit 63*b* can also be controlled for each frame composed of the subfields in accordance with display data signals of the frame.

With respect to each of the XY-electrode line pairs $X_1Y_1$ through $X_nY_n$ of a subfield to be displayed, a data variation between display data of each XY-electrode line pair to be scanned and display data of another XY-electrode line pair to be scanned next, which is referred to as a line data variation, is obtained. Next, the sum n3 of line data variations is obtained with respect to all of the XY-electrode line pairs $X_1Y_1$ through $X_nY_n$ of the subfield. Next, with respect to all of the XY-electrode line pairs $X_1Y_1$ through $X_nY_n$ of the subfield, a data variation between display cells corresponding to the line data variation and their adjacent display cells, which is referred to as a cell data variation, is obtained.

Figure 12A:
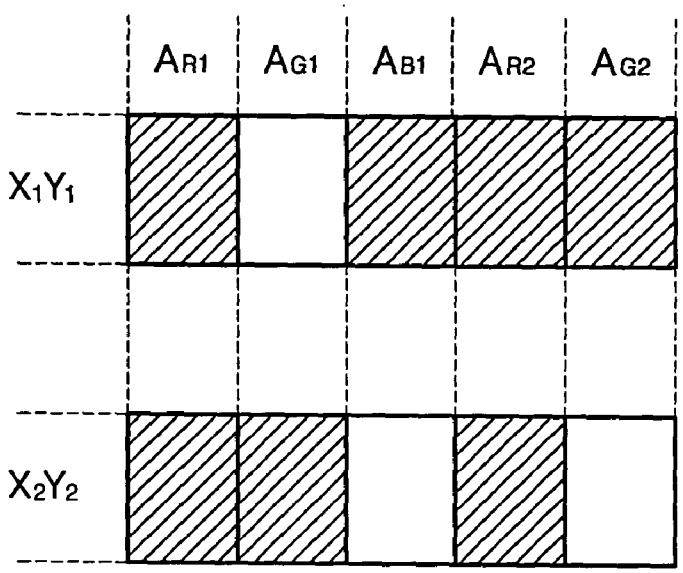
FIG. 12A is a first diagram showing an example of the logic state of the display data of a first XY-electrode line pair to be scanned first and the display data of a second XY-electrode line pair to be scanned next.

FIG. 12A is a first diagram showing an example of the logic state of the display data of a first XY-electrode line pair to be scanned first and the display data of a second XY-electrode line pair to be scanned next. Referring to FIG. 12A, it can be seen that data changes in the three address electrode lines $A_{G1}$, $A_{B1}$, and $A_{G2}$, and thus three capacitances $3C_X$ acting on a consumed power are generated among the address electrode lines $A_{G1}$, $A_{B1}$, and $A_{G2}$ and the second XY-electrode line pair $X_2Y_2$. In other words, a line data variation is $3C_X$. Here, each of three display cells corresponding to the line data variation has different data from its adjacent display cells at both sides. Accordingly, it can be inferred that five capacitances $5C_a$ acting on the consumed power are generated at both sides of each of the three display cells corresponding to the line data variation. That is, a cell data variation is $5C_a$.

Figure 12B:
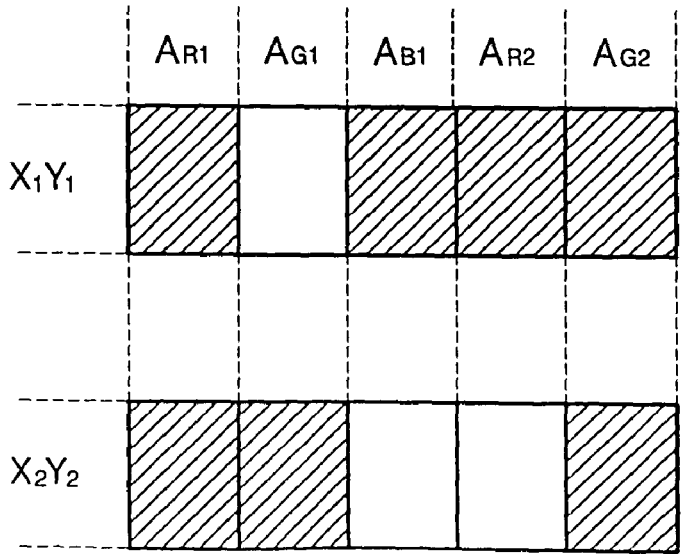
FIG. 12B is a second diagram showing an example of the logic state of the display data of a first XY-electrode line pair to be scanned first and the display data of a second XY-electrode line pair to be scanned next.

FIG. 12B is a second diagram showing an example of the logic state of the display data of a first XY-electrode line pair to be scanned first and the display data of a second XY-electrode line pair to be scanned next. Referring to FIG. 12B, it can be seen that data changes in the three address electrode lines $A_{G1}$, $A_{B1}$, and $A_{R2}$, and thus three capacitances $3C_X$ acting on the consumed power are generated among the address electrode lines $A_{G1}$, $A_{B1}$, and $A_{R2}$ and the second XY-electrode line pair $X_2Y_2$. In other words, a line data variation is $3C_X$. Here, as for display cells corresponding to the line data variation, two capacitances $2C_a$. acting on the consumed power are generated at both sides of a display cell defined by the first green address electrode line $A_{G1}$ and the first XY-electrode line pair $X_1Y_1$. The same address voltage $V_A$ is applied to a display cell defined by the first blue address electrode line $A_{B1}$ and the second XY-electrode line pair $X_2Y_2$ and a display cell defined by the second red address electrode line $A_{R2}$ and the second XY-electrode line pair $X_2Y_2$, and thus two capacitances $2C_a$ acting on the consumed power are generated. That is, a cell data variation is $4C_a$.

Figure 12C:
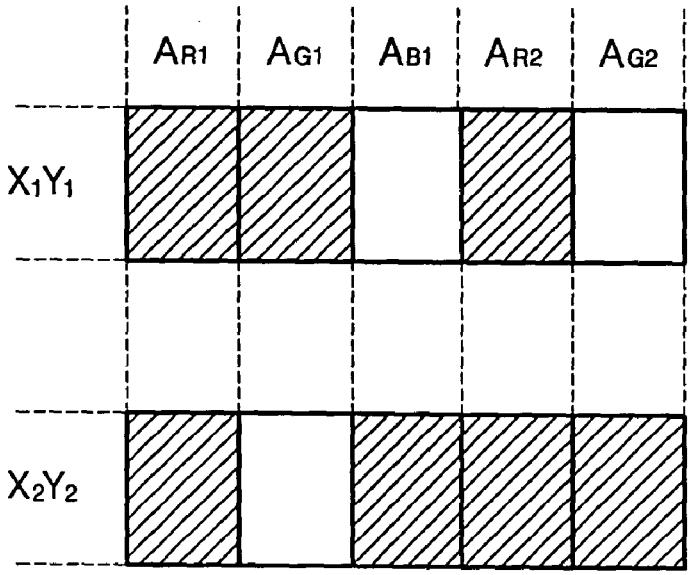
FIG. 12C is a third diagram showing an example of the logic state of the display data of a first XY-electrode line pair to be scanned first and the display data of a second XY-electrode line pair to be scanned next.

FIG. 12C is a third diagram showing an example of the logic state of the display data of a first XY-electrode line pair to be scanned first and the display data of a second XY-electrode line pair to be scanned next. Referring to FIG. 12C, it can be seen that data changes in the three address electrode lines $A_{G1}$, $A_{B1}$, and $A_{G2}$, and thus three capacitances $3C_X$ acting on a consumed power are generated between the address electrode lines ($A_{G1}$, $A_{B1}$, and $A_{G2}$, and the second XY-electrode line pair $X_2Y_2$. In other words, a line data variation is $3C_x$. Here, each of three display cells corresponding to the line data variation has different data from its adjacent display cells at both sides. Accordingly, it can be inferred that five capacitances $5C_a$ acting on the consumed power are generated at both sides of each of the three display cells corresponding to the line data variation. That is, a cell data variation is $5C_a$.

Figure 12D:
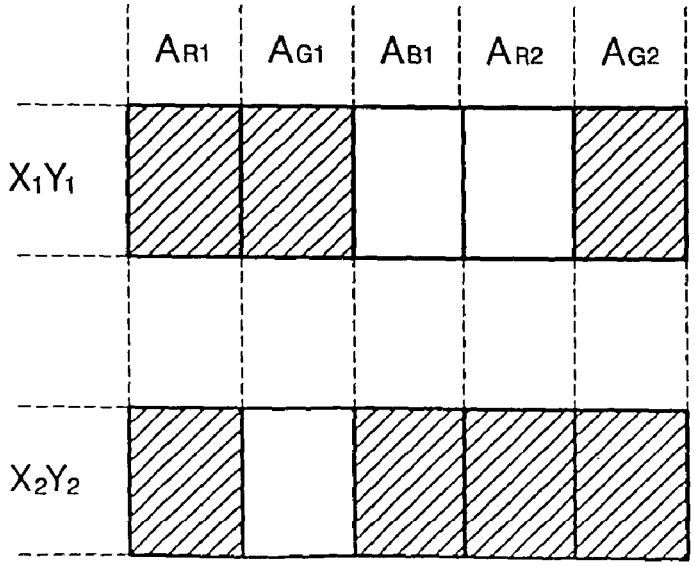
FIG. 12D is a fourth diagram showing an example of the logic state of the display data of a first XY-electrode line pair to be scanned first and the display data of a second XY-electrode line pair to be scanned next.

FIG. 12D is a fourth diagram showing an example of the logic state of the display data of a first XY-electrode line pair to be scanned first and the display data of a second XY-electrode line pair to be scanned next. Referring to FIG. 12D, it can be seen that data changes in the three address electrode lines $A_{G1}$, $A_{B1}$, and $A_{R2}$, and thus three capacitances $3C_X$ acting on the consumed power are generated between the address electrode lines ($A_{G1}$, $A_{B1}$, and $A_{R2}$) and the second XY-electrode line pair $X_2Y_2$. In other words, a line data variation is $3C_X$. Here, as for display cells corresponding to the line data variation, two capacitances $2C_a$ acting on the consumed power are generated at both sides of a display cell defined by the first green address electrode line $A_{G1}$ and the second XY-electrode line pair $X_2Y_2$. The same address voltage $V_A$ is applied to a display cell defined by the first blue address electrode line $A_{B1}$ and the first XY-electrode line pair $X_1Y_1$ and a display cell defined by the second red address electrode line $A_{R2}$ and the first XY-electrode line pair $X_1Y_1$, and thus two capacitances $2C_a$ acting on the consumed power are generated. That is, a cell data variation is $4C_a$.

Figure 12E:
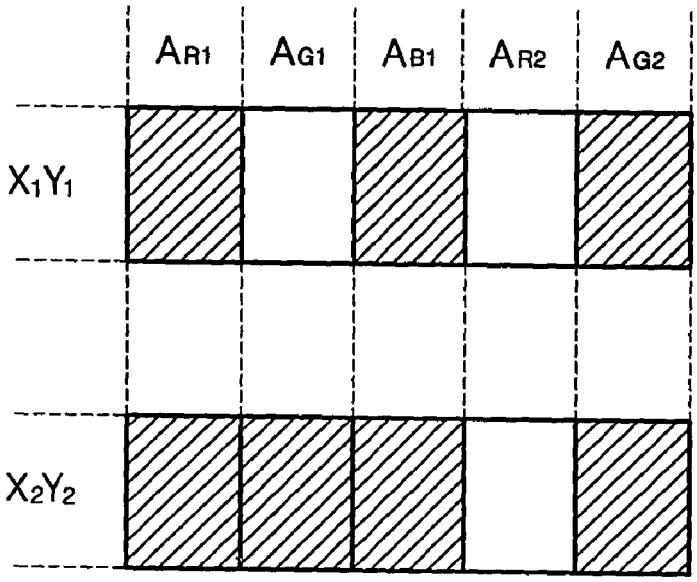
FIG. 12E is a fifth diagram showing an example of the logic state of the display data of a first XY-electrode line pair to be scanned first and the display data of a second XY-electrode line pair to be scanned next.

FIG. 12E is a fifth diagram showing an example of the logic state of the display data of a first XY-electrode line pair to be scanned first and the display data of a second XY-electrode line pair to be scanned next. Referring to FIG. 12E, it can be seen that data changes in the one address electrode line $A_{G1}$, and thus one capacitance $C_X$ acting on the consumed power is generated between the address electrode line $A_{G1}$ and the second XY-electrode line pair $X_2Y_2$. In other words, a line data variation is $C_X$. Here, as for display cells corresponding to the line data variation, two capacitances $2C_a$ acting on the consumed power are generated at both sides of a display cell defined by the first green address electrode line $A_{G1}$ and the first XY-electrode line pair $X_1Y_1$. That is, a cell data variation is $2C_a$.

Figure 12F:
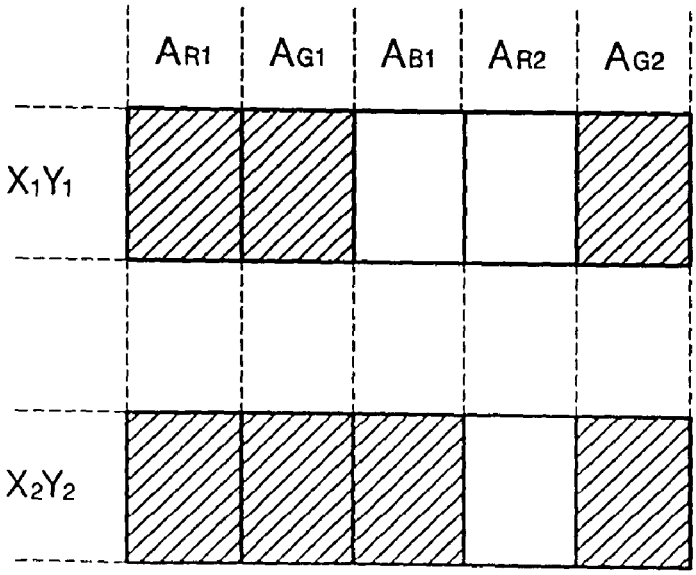
FIG. 12F is a sixth diagram showing an example of the logic state of the display data of a first XY-electrode line pair to be scanned first and the display data of a second XY-electrode line pair to be scanned next.

FIG. 12F is a sixth diagram showing an example of the logic state of the display data of a first XY-electrode line pair to be scanned first and the display data of a second XY-electrode line pair to be scanned next. Referring to FIG. 12F, it can be seen that data changes in the one address electrode line $A_{B1}$, and thus one capacitance $C_X$ acting on the consumed power is generated between the address electrode line $A_{B1}$ and the second XY-electrode line pair $X_2Y_2$. In other words, a line data variation is $C_X$. Here, as for display cells corresponding to the line data variation, one capacitance $C_a$ acting on the consumed power is generated on the left of a display cell defined by the first blue address electrode line $A_{B1}$ and the first XY-electrode line pair $X_1Y_1$, and one capacitance $C_a$ acting on the consumed power is generated on the right of a display cell defined by the first blue address electrode line $A_{B1}$ and the second XY-electrode line pair $X_2Y_2$. That is, a cell data variation is $2C_a$.

According to the method described above with reference to FIGS. 12A through 12F, a line data variation between display data of each XY-electrode line pair to be scanned and display data of another XY-electrode line pair to be scanned next is obtained. Next, with respect to all of the XY-electrode line pairs of the subfield, a cell data variation between display cells corresponding to the line data variation and their adjacent display cells is obtained.

Next, the sum n4 of cell data variations obtained with respect to all of the XY-electrode line pairs $X_1Y_1$ through $X_nY_n$ of the subfield is obtained. Next, the sum n3 of line data variations and the sum n4 of cell data variations are added up to obtain a total of data variations in the subfield. Next, if the total data variation of the subfield exceeds a predetermined reference value, the power recovery circuit 63*b* is operated.

Here, when it is assumed that the sum of line data variations with respect to all of the XY-electrode line pairs of a subfield is $n3 \cdot C_X$, a coefficient of the sum $n3 \cdot C_x$ of line data variations is "a", the sum of cell data variations with respect to all of the XY-electrode line pairs of the subfield is $n4 \cdot C_a$, and a coefficient of the sum $n4 \cdot C_a$ of cell data variations is "b", an addressing power $P_{ASN}$ in the subfield during non-operation of the power recovery circuit 63*b* can be calculated using Formula (1).

$$P_{ASN}=a \cdot n3 \cdot C_x+b \cdot n4 \cdot C_a \quad (1)$$

Figure 13:
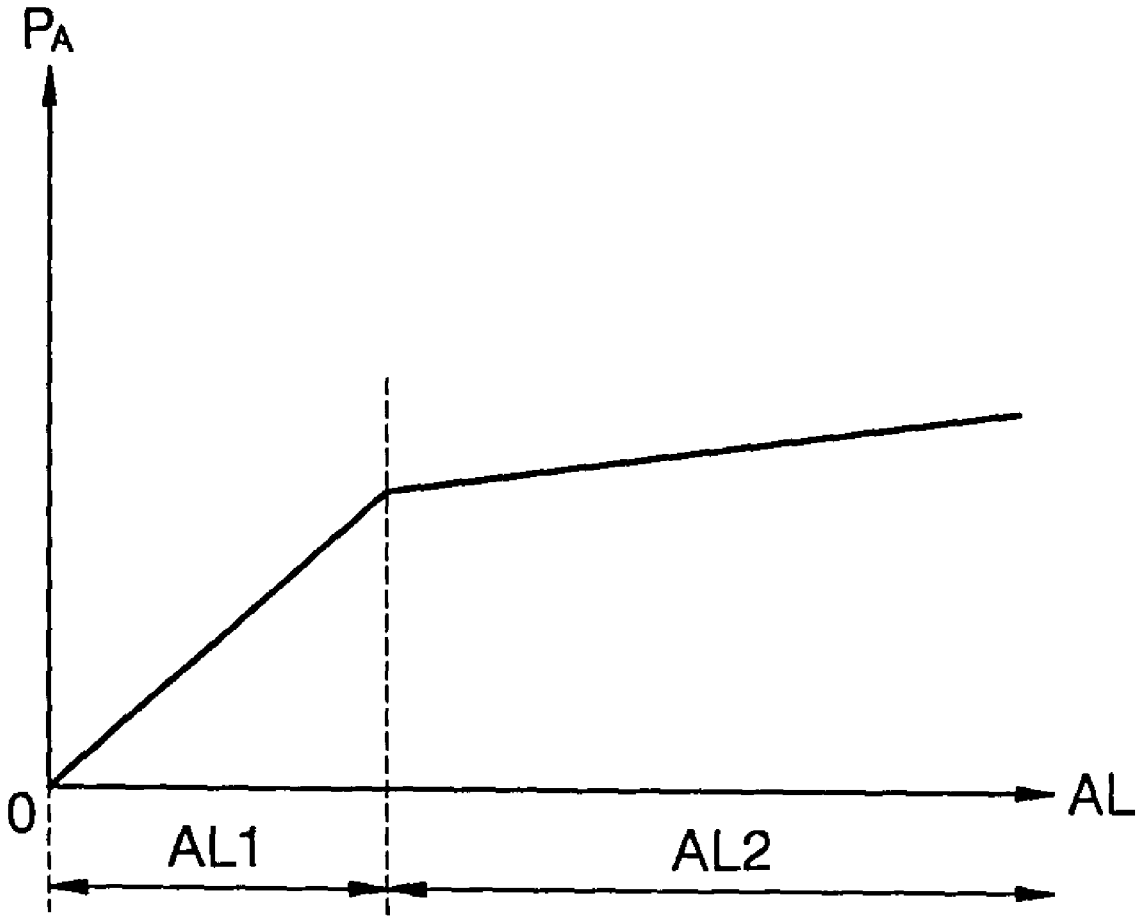
FIG. 13 is a graph showing an addressing power versus an address load factor by which the operation or non-operation of the power recovery circuit 63*b* shown in FIG. 6 is controlled in accordance with a driving method of the present invention.

FIG. 13 is a graph showing an addressing power versus an address load factor by which the operation or non-operation of the power recovery circuit 63*b* shown in FIG. 6 is controlled in accordance with a driving method of the present invention. FIG. 13 is a graph showing an addressing power $P_A$ versus an address load factor AL by which the operation or non-operation of the power recovery circuit 63*b* shown in FIG. 6 is controlled in accordance with a driving method of the present invention. In FIG. 13, a first address load factor AL1 is proportional to the sum of line data variations and the sum of cell data variations. A second address load factor AL2 is proportional to the number of display cells to be turned on and the number of display cells to be turned off in adjacency of the display cells to be turned on. In other words, referring to FIG. 13, it can be inferred that the predetermined reference value in the first embodiment is the maximum value of the first address load factor AL1.

In the meantime, a line data variation is obtained as follows. Firstly, an exclusive OR operation is performed on the display data of an XY-electrode line pair to be scanned first and the display data of an XY-electrode line pair to be scanned next. Secondarily, the number of 1s in data resulting from the exclusive OR operation is set as the line data variation.

Here, a cell data variation is obtained as follows. Firstly, an AND operation is performed on the display data of the XY-electrode line pair to be scanned first and the data resulting from the exclusive OR operation to obtain a first variation data. Secondarily, an AND operation is performed on the display data of the XY-electrode line pair to be scanned next and the data resulting from the exclusive OR operation to obtain a second variation data. Thirdly, the number of bits of different data between the first variation data and the second variation data is obtained and set as the cell data variation.

In a second embodiment of the present invention, under the condition that the operation or non-operation of the power recovery circuit 63*b* is controlled for each subfield in accordance with display data signals of the subfield, an addressing power during the operation of the power recovery circuit 63*b* is predicted, and the power recovery circuit 63*b* is not operated when the addressing power exceeds a predetermined reference value.

The following description concerns a method of predicting the addressing power. Through this method, the operation or non-operation of the power recovery circuit 63*b* can be controlled for each subfield in accordance with the display data signals of the subfield, and the operation or non-operation of the power recovery circuit 63*b* can also be controlled for each frame composed of the subfields in accordance with display data signals of the frame.

With respect to each of the XY-electrode line pairs $X_1Y_1$ through $X_nY_n$ of a subfield to be displayed, the number of display cells to be turned on is counted. Next, the number of display cells to be turned off in adjacency of the display cells to be turned on is counted.

Figure 11A:
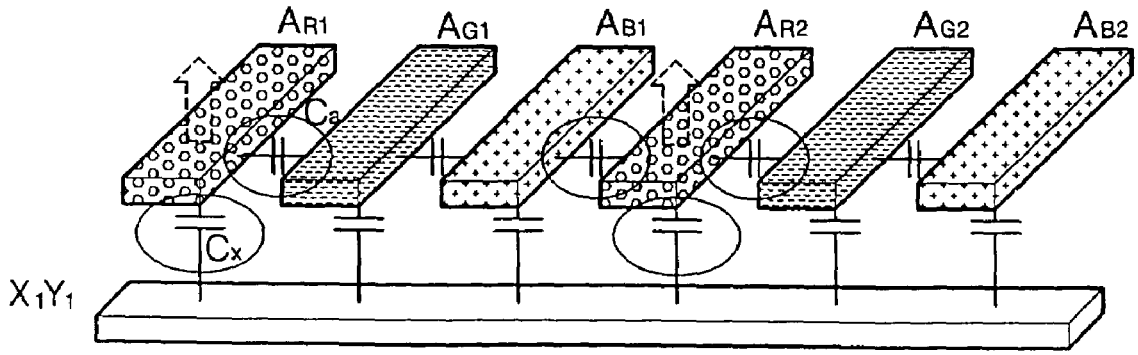
FIG. 11A is a diagram showing capacitance determining a consumed power when the power recovery circuit shown in FIG. 6 operates and red light is emitted.

Referring to FIG. 11A, with respect to the first XY-electrode line pair $X_1Y_1$, two display cells are turned on by the two address electrode lines $A_{R1}$ and $A_{R2}$. Thus, two capacitances $2C_X$ acting on a consumed power are generated among the two address electrode lines $A_{R1}$ and $A_{R2}$ and the first XY-electrode line pair $X_1Y_1$. With respect to the display cells to be turned on, one capacitance $C_a$ acting on the consumed power is generated on the right of the first red address electrode line $A_{R1}$, and two capacitances $2_{Ca}$ acting on the consumed power are generated at both sides of the second red address electrode line $A_{R2}$. In other words, the number of display cells to be turned off in adjacency of the display cells to be turned on is 3.

Figure 11B:
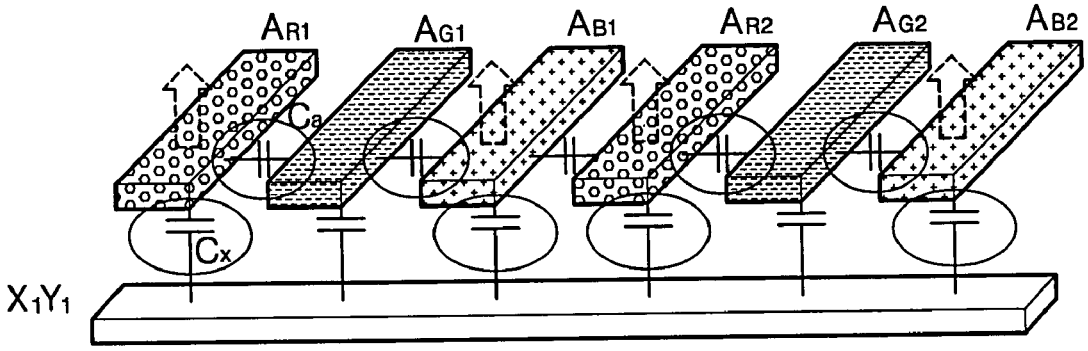
FIG. 11B is a diagram showing capacitance determining a consumed power when the power recovery circuit shown in FIG. 6 operates and magenta light is emitted.

Referring to FIG. 11B, with respect to the first XY-electrode line pair $X_1Y_1$, four display cells are turned on by the four address electrode lines $A_{R1}$, $A_{B1}$, $A_{R2}$, and $A_{B2}$. Thus, four capacitances $4C_X$ acting on a consumed power are generated among the four address electrode lines $A_{R1}$, $A_{B1}$, $A_{R2}$, and $A_{B2}$ and the first XY-electrode line pair $X_1Y_1$. With respect to the display cells to be turned on, one capacitance $C_a$ acting on the consumed power is generated on the right of the first red address electrode line $A_{R1}$, one capacitance $C_a$ acting on the consumed power is generated on the left of the first blue address electrode line $A_{B1}$, one capacitance $C_a$ acting on the consumed power is generated on the right of the second red address electrode line $A_{R2}$, and one capacitance $C_a$ acting on the consumed power is generated on the left of the second blue address electrode line $A_{B2}$. In other words, the number of display cells to be turned off in adjacency of the display cells to be turned on is 4.

Figure 11C:
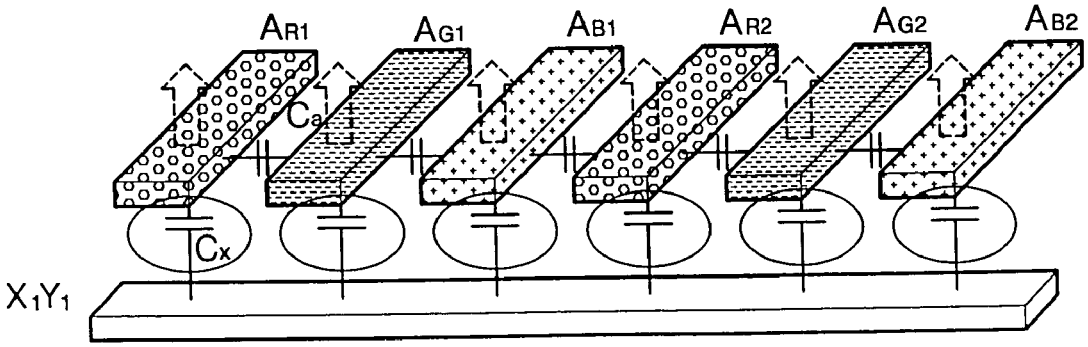
FIG. 11C is a diagram showing capacitance determining a consumed power when the power recovery circuit shown in FIG. 6 operates and white light is emitted.

Referring to FIG. 11C, with respect to the first XY-electrode line pair $X_1Y_1$, six display cells are turned on by the six address electrode lines $A_{R1}$ through $A_{B2}$. Thus, six capacitances $6C_X$ acting on a consumed power are generated among the six address electrode lines $A_{R1}$ through $A_{B2}$ and the first XY-electrode line pair $X_1Y_1$. In FIG. 11C, there is no display cell to be turned off in adjacency of the six display cells to be turned on.

According to the method described above with respect to FIGS. 11A through 11C, the number of display cells to be turned on can be counted with respect to each of the XY-electrode line pairs $X_1Y_1$ through $X_nY_n$ of a subfield to be displayed, and the number of display cells to be turned off in adjacency of the display cells to be turned on can also be counted.

Next, the number of display cells to be turned on and the number of display cells to be turned off in adjacency of the display cells to be turned on are added up. Next, when the result of the addition exceeds a predetermined reference value, the power recovery circuit 63*b* is not operated.

Here, when it is assumed that the sum of the numbers of display cells to be turned on with respect to all of the XY-electrode line pairs of the subfield is $n7 \cdot C_x$, a coefficient of the sum $n7 \cdot C_x$ is "c", the sum of the numbers of display cells to be turned off in adjacency of the display cells to be turned on is $n8 \cdot C_a$, and a coefficient of the sum $n8 \cdot C_a$ is "d", an addressing power $P_{AS}$ in the subfield during operation of the power recovery circuit 63*b* can be calculated using Formula (2).

$$P_{AS}=c \cdot n7 \cdot C_x+d \cdot n8 \cdot C_a \tag{2}$$

Referring to FIG. 13, it can be inferred that the predetermined reference value in the second embodiment is the minimum value of the second address load factor AL2.

In a third embodiment of the present invention, under the condition that the operation or non-operation of the power recovery circuit 63*b* is controlled for each XY-electrode line pair in accordance with the display data of an XY-electrode line pair to be scanned first and the display data of an XY-electrode line pair to be scanned next, an addressing power during the non-operation of the power recovery circuit 63*b* is predicted, and the power recovery circuit 63*b* is operated when the addressing power exceeds a predetermined reference value.

A method of predicting the addressing power has been described above, and thus a description thereof will be omitted. Briefly, when it is assumed that a line data variation with respect to each XY-electrode line pair is $n1 \cdot C_x$, a coefficient of the line data variation $n1 \cdot C_x$ is "a", a cell data variation with respect to the XY-electrode line pair is $n2 \cdot C_a$, and a coefficient of the cell data variation $n2 \cdot C_a$ of is "b", an addressing power $P_{ALN}$ between lines during the non-operation of the power recovery circuit 63*b* can be calculated using Formula (3).

$$P_{ALN}=a \cdot n1 \cdot C_x+b \cdot n2C_a \tag{3}$$

In a fourth embodiment of the present invention, under the condition that the operation or non-operation of the power recovery circuit 63*b* is controlled for each XY-electrode line pair in accordance with the display data of an XY-electrode line pair to be scanned first and the display data of an XY-electrode line pair to be scanned next, an addressing power during the operation of the power recovery circuit 63*b* is predicted, and the power recovery circuit 63*b* is not operated when the addressing power exceeds a predetermined reference value.

A method of predicting the addressing power has been described above, and thus a description thereof will be omitted. Briefly, when it is assumed that the number of display cells to be turned on with respect to each XY-electrode line pair is $n5 \cdot C_x$, a coefficient of the number $n5 \cdot C_x$ is "c", the number of display cells to be turned off in adjacency of the display cells to be turned on is $n6 \cdot C_a$, and a coefficient of the number $n6 \cdot C_a$ is "d", an addressing power $P_{AL}$ between lines during the operation of the power recovery circuit 63*b* can be calculated using Formula (4).

$$P_{AL}=c \cdot n5 \cdot C_x+d \cdot n6 \cdot C_a \quad (4)$$

In a fifth embodiment of the present invention, under the condition that a screen area is divided into a first address electrode line group and a second address electrode line group to independently drive the groups and that the operation or non-operation of the power recovery circuit 63*b* is controlled for each subfield in accordance with display data signals of the subfield, an addressing power during the non-operation of the power recovery circuit 63*b* is predicted, and the power recovery circuit 63*b* is operated when the addressing power exceeds a predetermined reference value. The following description concerns a driving method for realizing this operation.

Referring to FIGS. 1, 5, and 6, the address electrode lines AR1 through ABm are classified into the first address electrode line group and the second address electrode line group. The address driver 63 includes at least first and second address sub-drivers so that the first address sub-driver drives the first address electrode line group and the second address sub-driver drives the second address electrode line group. The power recovery circuit 63*b* includes first and second power recovery sub-circuits. The output of the first power recovery sub-circuit is connected to a power supply voltage line of the first address sub-driver, and the output of the second power recovery sub-circuit is connected to a power supply voltage line of the second address sub-driver. Here, a method of predicting the addressing power has been described above, and thus a description thereof will be omitted.

In a sixth embodiment of the present invention, under the condition that a screen area is divided into a first address electrode line group and a second address electrode line group to independently drive the groups and that the operation or non-operation of the power recovery circuit 63*b* is controlled for each XY-electrode line pair in accordance with the display data signals of the XY-electrode line pair, an addressing power during the non-operation of the power recovery circuit 63*b* is predicted, and the power recovery circuit 63*b* is operated when the addressing power exceeds a predetermined reference value. Here, a method of predicting the addressing power has been described above, and thus a description thereof will be omitted.

In a seventh embodiment of the present invention, under the condition that a screen area is divided into a first address electrode line group and a second address electrode line group to independently drive the groups and that the operation or non-operation of the power recovery circuit 63*b* is controlled for each subfield in accordance with display data signals of the subfield, an addressing power during the operation of the power recovery circuit 63*b* is predicted, and the power recovery circuit 63*b* is not operated when the addressing power exceeds a predetermined reference value. Here, a method of predicting the addressing power has been described above, and thus a description thereof will be omitted.

In an eighth embodiment of the present invention, under the condition that a screen area is divided into a first address electrode line group and a second address electrode line group to independently drive the groups and that the operation or non-operation of the power recovery circuit 63*b* is controlled for each XY-electrode line pair in accordance with the display data signals of the XY-electrode line pair, an addressing power during the operation of the power recovery circuit 63*b* is predicted, and the power recovery circuit 63*b* is not operated when the addressing power exceeds a predetermined reference value. Here, a method of predicting the addressing power has been described above, and thus a description thereof will be omitted.

As described above, in a method of driving a 3-electrode plasma display apparatus according to the present invention, the operation or non-operation of a power recovery circuit is controlled in accordance with display data signals applied to address electrode lines so that the characteristics of video data are adaptively reflected. Consequently, generation of unnecessary addressing power can be prevented.

The foregoing paragraphs describe the details of the present invention as it relates to a method of driving a 3-electrode plasma display apparatus, and more particularly, to a method of surface discharge type 3-electrode plasma display apparatus in which X- and Y-electrode lines alternate in parallel so as to form XY-electrode line pairs and display cells are defined at intersections between the XY-electrode line pairs and address electrode lines orthogonal to the XY-electrode line pairs.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit and scope of the applicant's general inventive concept. The present invention is not restricted to the above-described embodiments, and it will be apparent that various changes can be made by those skilled in the art without departing from the spirit of the invention.

What is claimed is:

1. A method of driving a 3-electrode plasma display apparatus, the method comprising:

converting an external analog video signal into a digital signal to generate an internal video signal;

generating drive control signals at a controller in response to the internal video signal;

processing an X-drive control signal output from the controller and applying the result of said processing of the X-drive control signal to X-electrode lines;

processing a Y-drive control signal output from the controller and applying the result of said processing of the Y-drive control signal to Y-electrode lines;

processing an address signal at an address driver to generate display data signals and applying the display data signals to address electrode lines, the address signal being output from the controller, the apparatus including a 3-electrode plasma display panel, with the panel including the X-electrode lines, Y-electrode lines, and address electrode lines, the X-electrode lines and Y-electrode lines being alternately arranged in parallel on a rear surface of a front transparent substrate to form XY-electrode line pairs, the address electrode lines being arranged on a front surface of a rear transparent substrate to cross the XY-electrode line pairs, with intersections of the XY-electrode line pairs and the address electrode lines defining display cells;

predicting a first addressing power of the plasma display panel during a non-operation of a power recovery circuit and operating the power recovery circuit when the first addressing power exceeds a first predetermined reference value;

predicting a second addressing power of the plasma display panel during an operation of the power recovery circuit and not operating the power recovery circuit when the second addressing power exceeds a second predetermined reference value;

collecting excess charges remaining in the display cells upon said operation of said power recovery circuit at the end of said applying the display data signals, said collecting excess charges being performed by said power recovery circuit; and applying the collected charges to the display cells upon said operation of said power recovery circuit at the start of said applying the display data signals.

2. A method of driving a 3-electrode plasma display apparatus, the method comprising:

converting an external analog video signal into a digital signal to generate an internal video signal;

generating drive control signals at a controller in response to the internal video signal;

processing an X-drive control signal output from the controller and applying the result of said processing of the X-drive control signal to X-electrode lines;

processing a Y-drive control signal output from the controller and applying the result of said processing of the Y-drive control signal to Y-electrode lines;

processing an address signal at an address driver to generate display data signals and applying the display data signals to address electrode lines, the address signal being output from the controller, the apparatus including a 3-electrode plasma display panel, with the panel including the X-electrode lines, Y-electrode lines, and address electrode lines, the X-electrode lines and Y-electrode lines being alternately arranged in parallel on a rear surface of a front transparent substrate to form XY-electrode line pairs, the address electrode lines being arranged on a front surface of a rear transparent substrate to cross the XY-electrode line pairs, with intersections of the XY-electrode line pairs and the address electrode lines defining display cells;

collecting excess charges remaining in the display cells when said applying of the display data signals ends, said collecting being performed by a power recovery circuit included in the address driver;

applying the collected charges to the display cells when said applying of the display data signals starts;

controlling operation and non-operation of the power recovery circuit in dependence upon said applying of the display data signals to the address electrode lines;

uniformizing charges in display cells to be driven, said uniformizing corresponding to an initialization step;

determining a charge state of display cells to be turned on and a charge state of display cells to be turned off, said determining corresponding to an address step;

provoking the display cells to be turned on to perform a display discharge, said provoking corresponding to a display-sustaining step; and said uniformizing, determining, and provoking being performed in a unit subfield, the operation and non-operation of the power recovery circuit being controlled in dependence upon the display data signals applied to the address electrode lines in the address step.

3. The method of claim 2, with the operation and non-operation of the power recovery circuit being controlled for each subfield in accordance with the display data signals of the respective subfield.

4. The method of claim 3, with said controlling of the operation and non-operation of the power recovery circuit comprising:

obtaining a line data variation between display data of each XY-electrode line pair to be scanned first and display data of each XY-electrode line pair to be scanned next, for each of the XY-electrode line pairs of a subfield to be displayed;

obtaining a sum of line data variations obtained for all of the XY-electrode line pairs of the subfield to be displayed;

obtaining a cell data variation between the display cells corresponding to the line data variation and adjacent display cells, for all of the XY-electrode line pairs of the subfield to be displayed;

obtaining a sum of cell data variations obtained for all of the XY-electrode line pairs of the subfield to be displayed;

adding the sum of line data variations and the sum of cell data variations to obtain a total of data variations in the subfield to be displayed; and operating the power recovery circuit when the total of data variations in the subfield to be displayed exceeds a predetermined reference value.

5. The method of claim 4, with said obtaining of the line data variation comprising:

performing an exclusive OR operation on the display data of the XY-electrode line pair to be scanned first and the display data of the XY-electrode line pair to be scanned next; and setting the line data variation to be equal to number of ls in data resulting from the exclusive OR operation.

6. The method of claim 5, with said obtaining of the cell data variation comprising:

performing an AND operation on the display data of the XY-electrode line pair to be scanned first and the data resulting from the exclusive OR operation to obtain a first variation data;

performing an AND operation on the display data of the XY-electrode line pair to be scanned next and the data resulting from the exclusive OR operation to obtain a second variation data; and obtaining number of bits of different data between the first variation data and the second variation data and setting the obtained number as the cell data variation.

7. The method of claim 3, with said controlling of the operation and non-operation of the power recovery circuit comprising:

counting number of display cells to be turned on corresponding to each of the XY-electrode line pairs of a subfield to be displayed;

counting number of display cells to be turned off in adjacency of the display cells to be turned on;

adding the number of display cells to be turned on and the number of display cells to be turned off in adjacency of the display cells to be turned on; and when the result of the addition exceeds a predetermined reference value, not operating the power recovery circuit.

8. The method of claim 2, with said controlling of the operation and non-operation of the power recovery circuit being performed for each of the XY- electrode line pairs in dependence upon display data of an XY-electrode line pair to be scanned first and display data of an XY-electrode line pair to be scanned next.

9. The method of claim 8, with said controlling of the operation and non-operation of the power recovery circuit comprising:

obtaining a line data variation between the display data of the XY-electrode line pair to be scanned first and the display data of the XY-electrode line pair to be scanned next;

obtaining a cell data variation between display cells corresponding to the line data variation and their adjacent display cells;

adding the line data variation and the cell data variation to obtain a total of data variations; and when the total data variation exceeds a predetermined reference value, operating the power recovery circuit.

10. The method of claim 9, with said obtaining of the line data variation comprising:

performing an exclusive OR operation on the display data of the XY-electrode line pair to be scanned first and the display data of the XY-electrode line pair to be scanned next; and setting number of ls in data resulting from the exclusive OR operation as the line data variation.

11. The method of claim 10, with said obtaining of the cell data variation comprising:

performing an AND operation on the display data of the XY-electrode line pair to be scanned first and the data resulting from the exclusive OR operation to obtain a first variation data;

performing an AND operation on the display data of the XY-electrode line pair to be scanned next and the data resulting from the exclusive OR operation to obtain a second variation data; and obtaining number of bits of different data between the first variation data and the second variation data and setting the obtained number as the cell data variation.

12. The method of claim 8, with said controlling of the operation and non-operation of the power recovery circuit comprising:

counting number of display cells to be turned on corresponding to the XY-electrode line pair to be scanned next;

counting number of display cells to be turned off in adjacency of the display cells to be turned on;

adding the number of display cells to be turned on and the number of display cells to be turned off in adjacency of the display cells to be turned on; and when the result of the addition exceeds a predetermined reference value, not operating the power recovery circuit.

13. The method of claim 2, further comprising;

classifying the address electrode lines into at least a first address electrode line group and a second address electrode line group, the address driver including at least a first address sub-driver and a second address sub-driver, the power recovery circuit including at least first power recovery sub-circuit and a second power recovery sub-circuit, the first power recovery sub-circuit having an output connected to a power supply voltage line of the first address sub-driver, the second power recovery sub-circuit having an output connected to a power supply voltage line of the second address sub-driver;

driving the first address electrode line group by the first address sub-driver; and driving the second address electrode line group by the second address sub-driver.

14. The method of claim 13, with the operation and non-operation of the first power recovery sub-circuit and the second power recovery sub-circuit being controlled for each subfield in dependence upon the display data signals of the subfield.

15. The method of claim 14, with said controlling of the operation and non-operation of the power recovery circuit comprising:

obtaining a first line data variation between display data of each XY-electrode line pair to be scanned first and display data of each XY-electrode line pair to be scanned next, for the first address electrode line group and each of the XY-electrode line pairs of a subfield to be displayed;

obtaining a second line data variation between display data of each XY-electrode line pair to be scanned first and display data of each XY-electrode line pair to be scanned next, for the second address electrode line group and each of the XY-electrode line pairs of the subfield to be displayed;

obtaining a first sum of line data variations obtained for the first address electrode line group and all of the XY-electrode line pairs of the subfield;

obtaining a second sum of line data variations obtained for the second address electrode line group and all of the XY-electrode line pairs of the subfield;

obtaining a first cell data variation between display cells corresponding to the line data variation and adjacent display cells, for the first address electrode line group and all of the XY-electrode line pairs of the subfield;

obtaining a second cell data variation between display cells corresponding to the line data variation and adjacent display cells, for the second address electrode line group and all of the XY-electrode line pairs of the subfield;

obtaining a first sum of cell data variations obtained for the first address electrode line group and all of the XY-electrode line pairs of the subfield;

obtaining a second sum of cell data variations obtained for the second address electrode line group and all of the XY-electrode line pairs of the subfield;

adding the first sum of line data variations and the first sum of cell data variations to obtain a first total of data variations in the subfield;

adding the second sum of line data variations and the second sum of cell data variations to obtain a second total of data variations in the subfield;

when the first total data variation of the subfield exceeds a predetermined reference value, operating the first power recovery sub-circuit; and when the second total data variation of the subfield exceeds a predetermined reference value, operating the second power recovery sub-circuit.

16. The method of claim 14, with said controlling of the operation and non-operation of the power recovery circuit comprising:

counting number of first display cells to be turned on corresponding to the first address electrode line group and each of the XY-electrode line pairs of a subfield to be displayed;

counting number of second display cells to be turned on corresponding to the second address electrode line group and each of the XY-electrode line pairs of the subfield to be displayed;

counting number of first adjacent display cells to be turned off in adjacency of the first display cells to be turned on;

counting number of second adjacent display cells to be turned off in adjacency of the second display cells to be turned on;

adding the number of the first display cells to be turned on and the number of the first adjacent display cells to be turned off in adjacency of the first display cells to be turned on, to obtain a first addition result;

adding the number of the second display cells to be turned on and the number of the second adjacent display cells to be turned off in adjacency of the second display cells to be turned on, to obtain a second addition result;

when the first addition exceeds a predetermined reference value, not operating the first power recovery sub-circuit; and when the second addition exceeds a predetermined reference value, not operating the second power recovery sub-circuit.

17. The method of claim 13, with the operation and non-operation of the first power recovery sub-circuit and the second power recovery sub-circuit being controlled for each XY-electrode line pair in dependence upon display data of an XY-electrode line pair to be scanned first and display data of an XY-electrode line pair to be scanned next.

18. The method of claim 17, with said controlling of the operation and non-operation of the power recovery circuit comprising:

obtaining a first line data variation between the display data of the XY-electrode line pair to be scanned first and the display data of the XY-electrode line pair to be scanned next, corresponding to the first address electrode line group;

obtaining a second line data variation between the display data of the XY-electrode line pair to be scanned first and the display data of the XY-electrode line pair to be scanned next, corresponding to the second address electrode line group;

obtaining a first cell data variation between display cells corresponding to the first line data variation and their adjacent display cells;

obtaining a second cell data variation between display cells corresponding to the second line data variation and their adjacent display cells;

adding the first line data variation and the first cell data variation to obtain a first total of data variations;

adding the second line data variation and the second cell data variation to obtain a second total of data variations;

when the first total data variation exceeds a predetermined reference value, operating the first power recovery sub-circuit; and when the second total data variation exceeds a predetermined reference value, operating the second power recovery sub-circuit.

19. The method of claim 17, with said controlling of the operation and non-operation of the power recovery circuit comprising:

counting number of first display cells to be turned on corresponding to the first address electrode line group and the XY-electrode line pair to be scanned next;

counting number of second display cells to be turned on corresponding to the second address electrode line group and the XY-electrode line pair to be scanned next;

counting number of first adjacent display cells to be turned off in adjacency of the first display cells to be turned on;

counting number of second adjacent display cells to be turned off in adjacency of the second display cells to be turned on;

adding the number of the first display cells to be turned on and the number of the first adjacent display cells to be turned off, to obtain a first addition result;

adding the number of the second display cells to be turned on and the number of the second adjacent display cells to be turned off, to obtain a second addition result;

when the first addition result exceeds a predetermined reference value, not operating the first power recovery sub-circuit; and when the second addition result exceeds a predetermined reference value, not operating the second power recovery sub-circuit.

20. The method of claim 2, with the operation and non-operation of the power recovery circuit being controlled for each frame in dependence upon display data signals of the frame composed of a plurality of subfields.

21. A method of driving a plasma display apparatus, the method comprising:

processing an address signal at an address driver to generate display data signals and applying the display data signals to address electrode lines;

predicting a first addressing power of the plasma display apparatus during a non-operation of a power recovery circuit and operating the power recovery circuit when the first addressing power exceeds a first predetermined reference value;

predicting a second addressing power of the plasma display apparatus during an operation of the power recovery circuit and not operating the power recovery circuit when the second addressing power exceeds a second predetermined reference value;

collecting excess charges remaining in display cells upon said operation of said power recovery circuit at the end of said applying the display data signals, said collecting excess charges being performed by said power recovery circuit; and applying the collected charges to the display cells upon said operation of said power recovery circuit at the start of said applying the data display data signals.

22. The method of claim 21, further comprising uniformizing charges in display cells to be driven, said uniformizing corresponding to an initialization step;

determining a charge state of display cells to be turned on and a charge state of display cells to be turned off, said determining corresponding to an address step;

provoking the display cells to be turned on to perform a display discharge, said provoking corresponding to a display-sustaining step; and said uniformizing, determining, and provoking being performed in a unit subfield.

23. The method of claim 22, with the operation and non-operation of the power recovery circuit being controlled for each subfield in accordance with the display data signals of the respective subfield.

24. The method of claim 22, further comprising classifying the address electrode lines into at least a first address electrode line group and a second address electrode line group, the address driver including at least a first address sub-driver and a second address sub-driver, the power recovery circuit including at least first power recovery sub-circuit and a second power recovery sub-circuit, the first power recovery sub-circuit having an output connected to a power supply voltage line of the first address sub-driver, the second power recovery sub-circuit having an output connected to a power supply voltage line of the second address sub-driver;

driving the first address electrode line group by the first address sub-driver; and driving the second address electrode line group by the second address sub-driver.

25. A display apparatus, comprising:

a plasma display panel comprising X-electrode lines, Y-electrode lines, and address electrode lines, said X-electrode lines and said Y-electrode lines being alternately arranged in parallel on a rear surface of a front transparent substrate to form XY-electrode line pairs, said address electrode lines being arranged on a front surface of a rear transparent substrate to cross the XY-electrode line pairs, with intersections of the XY-electrode line pairs and the address electrode lines defining display cells;

a driving apparatus for driving said plasma display panel, said driving apparatus including a video processor, a logic controller, an address driver, aX-driver, and a Y-driver, said address driver generating display data signals, said display data signals being determined by a charge state of display cells to be turned on and a charge state of display cells to be turned off; and a power recovery circuit for collecting excess charges remaining in display cells and applying the collected charges to said display cells, said power recovery circuit being included in said address driver, said power recovery circuit being operated when a first addressing power of the plasma display panel during non-operation of the power recovery circuit is predicted to exceed a first predetermined reference value, said power recovery circuit not being operated when a second addressing power of the plasma display panel during operation of the power recovery circuit is predicted to exceed a second predetermined reference value.

26. The display apparatus of claim 25, with said driving apparatus generating a first waveform for uniformizing charges in display cells and a second waveform for provoking the display cells to be turned on to perform a display discharge.

27. The display apparatus of claim 26, with said power recovery circuit being controlled by obtaining a line data variation and a cell data variation, said line data variation being obtained between display data of each XY-electrode line pair to be scanned first and display data of each XY-electrode line pair to be scanned next, said cell data variation being obtained between display cells corresponding to the line data variation and adjacent display cells.

28. The display apparatus of claim 26, with said power recovery circuit being controlled by counting number of display cells to be turned on and number of display cells to be turned off in adjacency of the display cells to be turned on.

* * * * *